US008487845B2

(12) United States Patent
Kimura

(10) Patent No.: US 8,487,845 B2
(45) Date of Patent: Jul. 16, 2013

(54) SEMICONDUCTOR DEVICE AND DRIVING METHOD THEREOF

(75) Inventor: Hajime Kimura, Kanagawa (JP)

(73) Assignee: Semiconductor Energy Laboratory Co., Ltd., Atsugi-shi, Kanagawa-ken (JP)

( * ) Notice: Subject to any disclaimer, the term of this patent is extended or adjusted under 35 U.S.C. 154(b) by 982 days.

(21) Appl. No.: 12/272,441

(22) Filed: Nov. 17, 2008

(65) Prior Publication Data

US 2009/0174631 A1 Jul. 9, 2009

Related U.S. Application Data

(63) Continuation of application No. 10/838,268, filed on May 5, 2004, now Pat. No. 7,453,427.

(30) Foreign Application Priority Data

May 9, 2003 (JP) ..... 2003-131824

(51) Int. Cl.
*G09G 3/30* (2006.01)

(52) U.S. Cl.
USPC ..... 345/78; 345/206; 315/169.3

(58) Field of Classification Search
USPC ..... 345/76–80, 82, 204–206, 211, 81, 345/83; 315/169.1, 169.3
See application file for complete search history.

(56) References Cited

U.S. PATENT DOCUMENTS 5,552,677 A 9/1996 Pagones
6,229,506 B1 5/2001 Dawson
6,229,508 B1 * 5/2001 Kane ..... 345/82
6,373,454 B1 4/2002 Knapp
6,556,475 B2 4/2003 Yamazaki et al.
6,667,580 B2 12/2003 Kim et al.
6,774,878 B2 8/2004 Yoshida
6,989,826 B2 1/2006 Kasai
7,042,426 B2 5/2006 Shin
7,106,281 B2 9/2006 Kim (Continued)

FOREIGN PATENT DOCUMENTS

EP 1 130 565 9/2001
EP 1 275 421 1/2003

(Continued)

OTHER PUBLICATIONS

Hattori et al., "Circuit Simulation of Poly-Si TFT Based Current-writing Active-Matrix Organic LED Display," w/English Abstract, Shingakugihou Technical Report of IEICE, 2001, vol. ED 2001-8, SDM 2001-8, vol. 101, No. 15, pp. 7-14.

(Continued)

*Primary Examiner* — Tom Sheng
(74) *Attorney, Agent, or Firm* — Fish & Richardson P.C.

(57) ABSTRACT

A semiconductor device in which a signal current can be written quickly in a current source circuit of a current input type. A signal current is written after performing a pre-charge operation, thus the writing is performed quickly. In the pre-charge operation, a current is supplied to a plurality of circuits. The current size is set according to the number of the circuits to be supplied the current, which means the steady state can be obtained quickly. Note that a current may be supplied to a circuit other than the one to be input a signal in the pre-charge operation.

12 Claims, 38 Drawing Sheets

U.S. PATENT DOCUMENTS

| | | | | |
|---|---|---|---|---|
| 7,209,101 | B2 * | 4/2007 | Abe | 345/76 |
| 7,256,756 | B2 | 8/2007 | Abe | |
| 7,310,092 | B2 * | 12/2007 | Imamura | 345/204 |
| 7,453,427 | B2 * | 11/2008 | Kimura | 345/78 |
| 7,466,311 | B2 | 12/2008 | Kasai | |
| 2003/0001828 | A1 | 1/2003 | Asano | |
| 2003/0030602 | A1 | 2/2003 | Kasai | |
| 2003/0038760 | A1 * | 2/2003 | Kim et al. | 345/76 |
| 2003/0043131 | A1 | 3/2003 | Iguchi | |
| 2003/0052842 | A1 | 3/2003 | Yoshida | |
| 2003/0090447 | A1 | 5/2003 | Kimura | |
| 2003/0122745 | A1 * | 7/2003 | Miyazawa | 345/76 |
| 2003/0128200 | A1 | 7/2003 | Yumoto | |
| 2006/0152451 | A1 | 7/2006 | Shin | |
| 2007/0217275 | A1 | 9/2007 | Abe | |
| 2009/0079677 | A1 | 3/2009 | Kasai | |

FOREIGN PATENT DOCUMENTS

| | | | |
|---|---|---|---|
| EP | 1274065 | A2 | 1/2003 |
| EP | 1 282 104 | | 2/2003 |
| EP | 1 291 839 | | 3/2003 |
| EP | 1 321 922 | | 6/2003 |
| EP | 1494203 | A2 | 1/2005 |
| JP | 2002-514320 | | 5/2002 |
| JP | 2002-517806 | | 6/2002 |
| JP | 2003-050564 | | 2/2003 |
| JP | 2003-66908 | | 3/2003 |
| JP | 2003-066908 | | 3/2003 |
| JP | 2003-076327 | | 3/2003 |
| JP | 2003-099001 | | 4/2003 |
| JP | 2003-108065 | | 4/2003 |
| JP | 2003-114645 | | 4/2003 |
| JP | 2003-150082 | | 5/2003 |
| JP | 2003-150116 | | 5/2003 |
| JP | 2003-157049 | | 5/2003 |
| JP | 2003-177709 | | 6/2003 |
| JP | 2003-195812 | | 7/2003 |
| JP | 2003-198512 | | 7/2003 |
| JP | 2004029803 | A | 1/2004 |
| KR | 20030004774 | A | 1/2003 |
| KR | 20030013273 | A | 2/2003 |
| WO | WO 98/48403 | | 10/1998 |
| WO | WO 01/06484 | | 1/2001 |
| WO | WO 02/39420 | | 5/2002 |
| WO | WO 03/027997 | | 4/2003 |
| WO | WO 03/038793 | | 5/2003 |
| WO | WO 03/038794 | | 5/2003 |
| WO | WO 03/038795 | | 5/2003 |
| WO | WO 03/038796 | | 5/2003 |
| WO | WO 03/038797 | | 5/2003 |

OTHER PUBLICATIONS

Han-Sang Lee et al., "P-39: An Improved Driving Method Using Precharge for Active Matrix OLED Displays," 2003 SID, IDRC 2003, pp. 285-287.

First Office Action dated Dec. 28, 2007 for Chinese Application No. 200410063975.5; CN7123, 7 pages with translation.

M. Shimoda et al., "New Pixel-Driving Scheme with Data-Line Pre-Charge Function for Active Matrix Organic Light Emitting Diode Displays," AMD3-3, IDW 2002, pp. 239-242.

* cited by examiner

PRIOR ART

PRIOR ART

PRIOR ART

PRIOR ART

PRIOR ART

PRIOR ART

SEMICONDUCTOR DEVICE AND DRIVING METHOD THEREOF

CROSS-REFERENCE TO RELATED APPLICATIONS

This application is a continuation of U.S. application Ser. No. 10/838,268, filed May 5, 2004, now allowed, which claims the benefit of a foreign priority application filed in Japan as Serial No. 2003-131824 on May 9, 2003, both of which are incorporated by reference.

BACKGROUND OF THE INVENTION

1. Field of the Invention

The present invention relates to a semiconductor device provided with a function of controlling current supply to a load by using a transistor, and more particularly to a semiconductor device which includes a pixel composed of a current drive light-emitting element whose brightness varies with a current and a signal driver circuit for driving the pixel, and a driving method thereof.

2. Description of the Related Art

Recently, a display device whose pixel is composed of a light-emitting element such as a light emitting diode (LED), that is a self-light emitting display device has been in the spotlight. Among light emitting elements used for the self-light emitting display device like the above, an organic light emitting diode (OLED), an organic EL element, and an electroluminescence (EL element) have been drawing attention and been more likely to be used for an organic EL display.

Since such a light-emitting element emits light by itself, it enables higher pixel visibility as compared to a liquid crystal display and does not require a backlight. Further, it exhibits high response speed and the brightness of the light-emitting element can be controlled corresponding to the current value flowing in the light-emitting element.

A passive matrix drive and an active matrix drive are known as the driving method of a display device using a self-light emitting element. Although the passive matrix drive has a simple configuration, there are problems such as the difficulty in realizing a display with large size and high brightness. Therefore, the active matrix drive in which a current flowing in a light-emitting element is controlled by a thin film transistor (TFT) which is disposed in a pixel circuit has been developed actively.

An active matrix display device has problems in that a current flowing in a light-emitting element varies due to variations in current characteristics of a driving TFT and thus brightness of each light-emitting element which structures a display screen varies. That is, the active matrix display device has a driving TFT for driving a light-emitting element into which a current flows in a pixel circuit and the current flowing in the light-emitting element varies due to the characteristic variations of the driving TFT, thus brightness varies.

In view of the aforementioned problems, various circuits are proposed in order that no current flowing in a light-emitting element varies even when characteristics of a driving TFT in a pixel circuit vary and thus variations of brightness is suppressed (e.g., see Patent Documents 1 to 4).

[Patent Document 1]

Japanese Patent Unexamined Publication No. 2002-517806

[Patent Document 2]

International Publication No. 01/06484 pamphlet

[Patent Document 3]

Japanese Patent Unexamined Publication No. 2002-514320

[Patent Document 4]

International Publication No. 02/39420 pamphlet

Configurations of active matrix display devices are disclosed in Patent Documents 1 to 4 and disclosed particularly in Patent Documents 1 to 3 are circuit configurations in which no current flowing in a light-emitting element varies due to characteristic variations of a driving TFT in a pixel circuit. This configuration is referred to as a current write type pixel or a current input type pixel. Disclosed in Patent Document 4 is a circuit configuration for suppressing variations in a signal current due to variations of a TFT in a source driver circuit.

A configuration of a conventional active matrix display device disclosed in Patent Document 1 is shown in FIG. 6. A pixel in FIG. 6 includes a source signal line 601, first to third gate signal lines 602 to 604, a current supply line 605, TFTs 606 to 609, a storage capacitor 610, an EL element 611, and a current source for inputting a video signal 612.

A gate electrode of the TFT 606 is connected to the first gate signal line 602, a first electrode thereof is connected to the source signal line 601, and a second electrode thereof is connected to first electrodes of the TFTs 607, 608, and 609. A gate electrode of the TFT 607 is connected to the second gate signal line 603 and a second electrode thereof is connected to a gate electrode of the TFT 608. A second electrode of the TFT 608 is connected to the current supply line 605. A gate electrode of the TFT 609 is connected to the third gate signal line 604 and a second electrode thereof is connected to an anode of the EL element 611. The storage capacitor 610 is connected between the gate electrode of the TFT 608 and the current supply line 605 so as to store a voltage between the gate and the source of the TFT 608. The current supply line 605 and a cathode of the EL element 611 are respectively input predetermined potentials to have a potential difference therebetween.

Operation through a signal current writing to a light emission will be explained using FIGS. 7A to 7E. Reference numerals denoting respective parts conform to those shown in FIG. 6. FIGS. 7A to 7C schematically show current flows. FIG. 7D shows the relationship between currents flowing in respective paths when a signal current is written. FIG. 7E shows a voltage stored in the storage capacitor 610, namely a voltage between the gate and the source of the TFT 608 when a signal current is written.

Firstly, a pulse is input to the first gate signal line 602 and the second gate signal line 603 and the TFTs 606 and 607 are turned ON. Current flowing through the source signal line 601, namely a signal current is referred to as Idata here.

As shown in FIG. 7A, since the signal current Idata is flowing through the source signal line 601, the current flows separately through current paths I1 and I2 in the pixel. FIG. 7D shows the relationship between the currents. Needless to say, the relationship is expressed as Idata=I1+I2.

Charge is not yet stored in the storage capacitor 610 at the instant when the TFT 606 is turned ON, and therefore the TFT 608 is OFF. Consequently, I2=0 and Idata=I1. That is, only a current flows due to the accumulation of charge in the storage capacitor 610 during this period.

The charge is then accumulated gradually in the storage capacitor 610, and a potential difference starts to generate between both electrodes of the storage capacitor 610 (see FIG. 7E). The TFT 608 is turned ON when the potential difference between both electrodes reaches Vth (point A in FIG. 7E), and I2 is generated. Since Idata=I1+I2 as mentioned above, I1 is gradually reduced. However, current still flows and charge is further accumulated in the storage capacitor 610.

The charge continues to be accumulated in the storage capacitor 610 until the potential difference between both electrodes of the storage capacitor 610, namely the voltage between the gate and the source of the TFT 608 reaches a desired voltage that is a voltage (VGS) at which the TFT 608 can flow the current Idata. When the accumulation of charge is complete (point B in FIG. 7E), the current I1 stops flowing and a current corresponding to VGS at this time starts to flow into the TFT 608, thus satisfies Idata=I2 (see FIG. 7B). In this way, the steady state is obtained. Signal writing operation is thus complete. When the selection of the first gate signal line 602 and the second gate signal line 603 is completed, the TFTs 606 and 607 are turned OFF.

In the subsequent light emitting operation, a pulse is input to the third gate signal line 604 and the TFT 609 is turned ON. Since the previously written VGS is stored in the storage capacitor 610, the TFT 608 is ON and the current Idata flows from the current supply line 605. Therefore, the EL element 611 emits light. In the case where the TFT 608 can operate in a saturation region, Idata can continue to flow without changing at this point even if the voltage between the source and the drain of the TFT 608 changes.

The operation for outputting a set current as described above is referred to as an output operation here. The current write type pixel as described above has an advantage in that a desired current can be supplied to an EL element accurately and thus variations in brightness due to the characteristic variations of TFTs can be suppressed since a voltage between the gate and the source which is required for flowing the current Idata is stored in the storage capacitor 610 even when the TFT 608 has characteristic variations and the like.

The above-described example relates to a technique for correcting current variations due to variations in driving TFT's in a pixel circuit; however, the same problem arises in a source driver circuit. A circuit configuration for preventing variations in signal currents due to manufacturing variations of TFTs in a source driver circuit is disclosed in Patent Document 4.

In this manner, a conventional current drive circuit and a display device employing it are configured so that the relationship between a signal current and a current for driving a TFT, or the relationship between a signal current and a current flowing in a light-emitting element during light emission can be equal or stay in proportion to each other.

In the cases where a driving current of a driving TFT for driving a light-emitting element is small or where a dark gradation is to be displayed by a light-emitting element, the signal current decreases accordingly. Since parasitic capacitance of a wiring used for supplying a signal current to a driving TFT and a light-emitting element is quite large, a time constant for charging the parasitic capacitance of the wiring becomes large when the signal current is small, which makes the signal writing speed slowed down. That is, the speed for supplying a current to a transistor, thereby generating a voltage at the gate terminal of the transistor becomes slow, which is required for the transistor to flow the current.

In view of the foregoing problems, technologies for improving the signal writing speed have been studied (e.g., see Patent Documents 5 and 6).

[Patent Document 5]

Japanese Patent Examined Publication Number 2003-50564

[Patent Document 6]

Japanese Patent Examined Publication Number 2003-76327

A display device provided with a current control means by which a data line current supplied by a data line drive means is divided into a data current for writing brightness information to each of pixel circuits and a bypass current to drive is disclosed in Patent Document 5. For example, as shown in FIG. 33, a pixel circuit in which no brightness data is written is used as a data current control circuit (bypass current).

The drive timing is shown in FIGS. 34 and 35. Sequential x pixel circuits (x=2 in FIG. 33) are selected at the same time. When two pixel circuits are selected at the same time, a part of a data line current for driving a data line is written into one pixel circuit as a brightness data current. To a part of the other pixel circuit, the brightness data current is not written, however, it is used as a data current control circuit (bypass current) to which the rest of the data line current flows.

In particular, in FIG. 35, sequential x pixel circuits (x=2 in FIG. 33) in the same column are sectioned as one block. When a data current is written to one pixel circuit within this block, no data current is written to the other pixel circuit within the block and the pixel circuit is used as a bypass current. At this time, in the pixel circuit to which a data current is written, both a first scan line WS and a second scan line ES are selected. In FIG. 33, assuming that a pixel circuit 11-*k*-1 is a pixel circuit for writing a data current for example, both WSk-1 and ESk-1 are selected.

On the other hand, in a pixel circuit to which no data current is written and used as a bypass current, only a first scan line WS is selected. In FIG. 33, WSk is selected and a second scan line ESk is not selected. Consequently, the pixel circuit functions as a data current control circuit in which TFTs 24 and 25 are used as bypass currents. That is, in the pixel circuit shown in FIG. 33, since the second scan line ESk is not selected and a TFT 26 is OFF, charge corresponding to brightness data which is stored in the capacitor 23 is prevented from being discharged through the TFT 26 and remains stored. At that time, a part of the circuit, namely only the TFTs 24 and 25 function as data current control circuits (bypass current).

As described above, in an active matrix organic EL display device using a current write type pixel circuit, sequential two pixel circuits in the same column are selected at the same time and a part of a data line current Iw0 is supplied to a pixel circuit to be written brightness data while the rest of the current is supplied to a part of the other pixel circuit as a bypass current. As a result, it is possible to set the data line current Iw0 larger than a data current Iw1 flowing in the TFTs 24 and 25 while suppressing the size of the TFT's 24 and 25 in the pixel circuit. Therefore, it becomes possible to drastically reduce the data writing time, thus contributes to the realization of an organic EL display device with larger size and higher definition.

A circuit shown in FIG. 36 is disclosed in Patent Document 6. That is, a driving transistor 7 is connected in parallel to an auxiliary transistor 12 having a current drive capacity of n times as large as that of the driving transistor 7 so that a drain current flows also to the auxiliary transistor 12 and a signal current flowing through a signal line 3 becomes (n+1) times as large during a part of the selection period (acceleration period). Therefore, charge and discharge of the storage capacitor and the parasitic capacitor can be performed at fast speed and a gate potential of the driving transistor reaches a predetermined potential during the selection period without failing, thus a current driving element can be driven with an appropriate driving current even in the case of a small signal current (input signal). Therefore, when a current driving element is an organic EL element, the organic EL element can be driven with a predetermined driving current and thus deterioration of display image quality is prevented.

SUMMARY OF THE INVENTION

As described above, although technologies for improving the signal writing speed have been studied, there remain several problems.

For example, in Patent Document 5, although the sequential two pixel circuits (x=2) in the same column are selected at the same time in writing a data current, the number of pixel circuits is not limited to two and more pixel circuits may be selected at the same time. As more pixel circuits are selected and more pixel circuits are used as data current pulses, a transistor with smaller size in a pixel circuit, namely the larger data line current Iw0 can be realized.

However, the distance between transistors which configure a current mirror circuit becomes farther in view of a trade-off feature and accordingly the effect of correcting variations in transistor characteristics is decreased.

Therefore, the number of pixel circuits which can be selected at the same time is limited and the size of data line current is also limited. Consequently, the signal writing speed is slowed down. In addition, when a number of pixel circuits are selected at the same time, currents are averaged to a current flowing in each pixel circuit. It prevents an accurate current from being input to a pixel circuit in which a data current is input. Accordingly the effect of correcting variations in transistor characteristics is decreased.

In Patent Document 6, a driving transistor 7 is connected in parallel to an auxiliary transistor 12 having a current drive capacity of n times as large as that of the driving transistor 7 so that a drain current flows also to the auxiliary transistor 12 and a signal current flowing through a signal line 3 becomes (n+1) times as large during a part of the selection period (acceleration period).

However, if the number of n is increased too much, the area occupied by the auxiliary transistor 12 becomes extremely large and thus the opening ratio is reduced. In addition, the number of n is limited corresponding to the layout area. Therefore, the magnification of a signal current flowing through the signal line 3 in a part of the selection period (acceleration period) is reduced. As a result, the signal writing speed is slowed down.

In order to solve the above-mentioned problems, it is an object of the present invention to provide a technology for improving the signal writing speed fully even when a signal current is small without suffering limitations due to the layout area, reducing the opening ratio, and decreasing the effect of correcting variations in transistor characteristics.

According to the present invention, a pre-charge period is provided prior to a setting period to complete the setting operation quickly. In the pre-charge operation, current is flowed not only to a transistor which is to be input a signal but also to other transistor. The current size is increased according to the increased number of the transistors to be supplied the current. Consequently, the large current can flow, thereby the steady state can be obtained quickly. Note that the state at this time is nearly equal to the one at which the setting operation is completed (when the steady state is obtained). Then, the setting operation is performed. The setting operation can be completed quickly since the state which is nearly equal to the one at the completion of the setting operation is obtained before performing the setting operation.

Note that, setting operation means an operation for supplying a current to a transistor to be input a signal, thereby generating a voltage at a gate terminal of the transistor which is required for the transistor to flow the current.

In addition, an operation for flowing a current not only to a transistor to be input a signal but also to other transistor in order to complete the setting operation quickly is referred to as a pre-charge operation, and a circuit having such a function is referred to as a pre-charge means.

One feature of the present invention is a semiconductor device comprising: a signal line; a current source circuit which is connectable to the signal line through a switch; a plurality of unit circuits each including the switch and the current source circuit; and a current supply means supplying a first current to current source circuits of M unit circuits selected from the plurality of the unit circuits in the pre-charge period, and supplying a second current to current source circuits of N unit circuits selected from the plurality of the unit circuits in the setting period.

The current source circuit comprises at least one transistor and, in many cases, a capacitor as well.

When a setting operation is performed to the unit circuit (the transistor which configures the current source circuit) with the small current, it takes long time to reach the steady state and complete a current writing operation. In order to solve this problem, a pre-charge operation is performed prior to the setting operation. By this pre-charge operation, the state which is nearly equal to the steady state can be obtained before the setting operation. That is, the pre-charge operation makes it possible to charge a potential at a gate terminal of the transistor which configures the current source circuit to quickly. The potential at the gate terminal of the transistor which configures the current source circuit becomes nearly equal to the potential at the setting operation by this pre-charge operation. Therefore, the setting operation can be completed more quickly by performing it after the pre-charge operation.

Another one feature of the invention is a semiconductor device comprising: a signal line; a current source circuit which is connectable to the signal line through a switch; a plurality of unit circuits each including the switch and the current source circuit; and a current supply means supplying a first current to current source circuits of M unit circuits selected from the plurality of the unit circuits in the pre-charge period, and supplying a second current to current source circuits of N unit circuits selected from the plurality of unit circuits except the M unit circuits in the setting period.

In other words, generally, the pre-charge operation is desirably performed to the circuits including the unit circuit to which the setting operation is performed in view of characteristic variations, however, the invention is not limited to this. The pre-charge operation may be performed using the unit circuit other than the unit circuit to which the setting operation is performed.

According to the above-described configuration, the invention provides the semiconductor device, wherein N=1.

Although a setting operation is normally performed to one unit circuit, the invention is not limited to this and currents may be supplied to a plurality of unit circuits in the setting operation.

In addition, according to the above-described configuration, the invention provides the semiconductor device, wherein the size ratio of the first current to the second current is M:N.

Any type of transistors may be utilized as the transistor in the invention. For example, it may be a thin film transistor (TFT) using an amorphous, polycrystalline, or single crystalline semiconductor film. Transistor formed on a single crystalline substrate, an SOI substrate, or a glass substrate may be adopted as well. Alternatively, transistor formed of an organic material, a carbon nanotube and the like may be adopted. Furthermore, the transistor may be a MOS transistor or a bipolar transistor.

Note that in this specification, connection means an electrical connection. Therefore, other elements or switches may be interposed between the shown elements.

According to the invention, a pre-charge operation is performed prior to a setting operation. Thus, the setting operation can be performed quickly even with the small current, and an accurate current can be output in the output operation.

DETAILED DESCRIPTION OF THE PREFERRED EMBODIMENTS

Embodiment Mode 1

According to the invention, a pixel is formed by an element which can control the light emission brightness corresponding to a current value flowing in a light-emitting element. Typically, an EL element can be employed. Although various structures of EL element are known, any structure can be employed as far as it can control the light emission brightness corresponding to a current value. That is, an EL element comprising a light-emitting layer, a charge transporting layer and a charge injection layer by any combination may be employed, which is formed by using a low molecular weight organic material, a medium molecular weight organic material (an organic light emitting material which has no sublimation property and in which the number of molecules is 20 or less or a length of chained molecules is 10 ì m or less), or a high molecular weight organic material. In addition, an inorganic material may be mixed or dispersed over these materials.

The invention can also be applied to various analog circuits each including a current source in addition to pixels each including a light-emitting element such as an EL element. Hereupon, the principle of the invention is described in the present embodiment mode.

Figure 1:
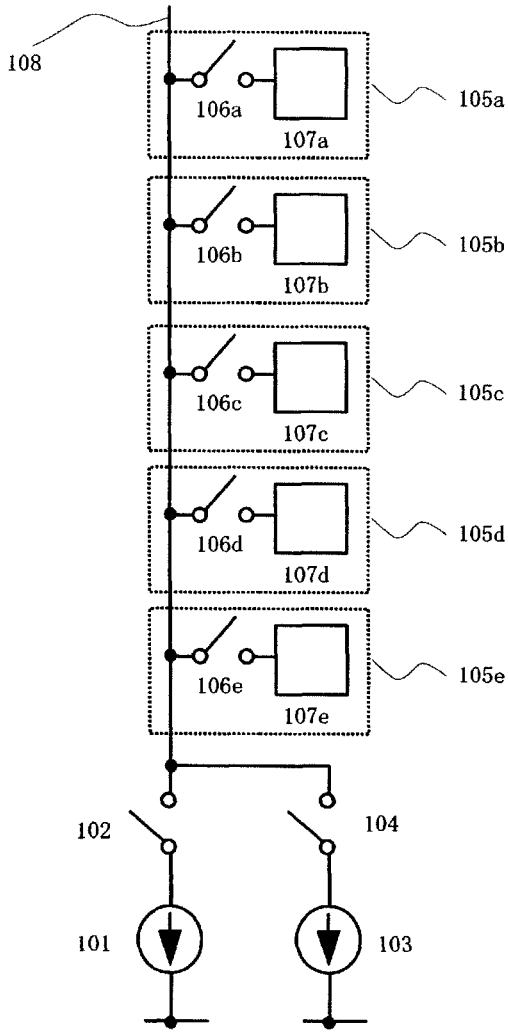
FIG. 1 is a configuration diagram of a semiconductor device of the invention.

The configuration based on the fundamental principle of the invention is shown in FIG. 1. A basic current source 101 is connected to a signal line 108 through a switch 102 and an additional current source 103 is connected in parallel to the basic current source 101 through a switch 104. In this manner, a current supply means is configured. It is needless to mention that the configuration of the current supply means is not limited to the one shown in FIG. 1, and any configuration can be employed as far as it can supply a predetermined current to the following unit circuit corresponding to the operation timing. For example, it is possible to omit switch and to employ a current source whose output is variable as desired. The number of current sources is not limited to two, and the larger number of current circuits or one current circuit may be employed alternatively.

A plurality of unit circuits 105*a* to 105*e* are connected to the signal line 108. In FIG. 1, five unit circuits are connected.

Each unit circuit comprises at least one switching circuit and one current source circuit, and thus the unit circuit 105*a*, for example, comprises a switching circuit 106*a* and a current source circuit 107*a*. The same applies to rest of the unit circuits 105*b* to 105*e*. The current source circuit comprises at least one transistor and, in many cases, a capacitor as well. The switching circuit comprises at least one switch.

Figure 2:
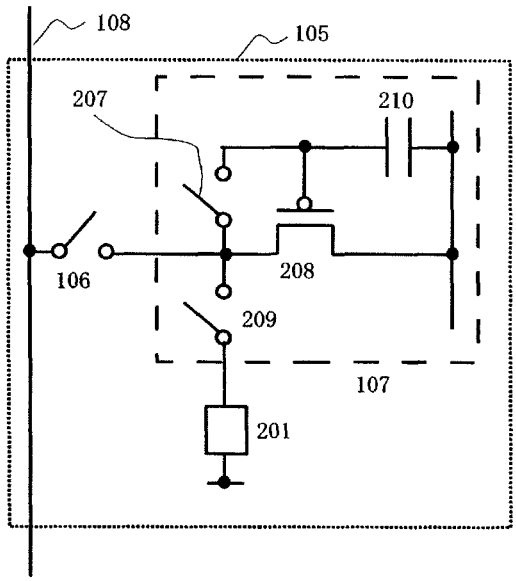
FIG. 2 is a diagram showing a configuration example of a unit circuit of the invention.
Figure 6:
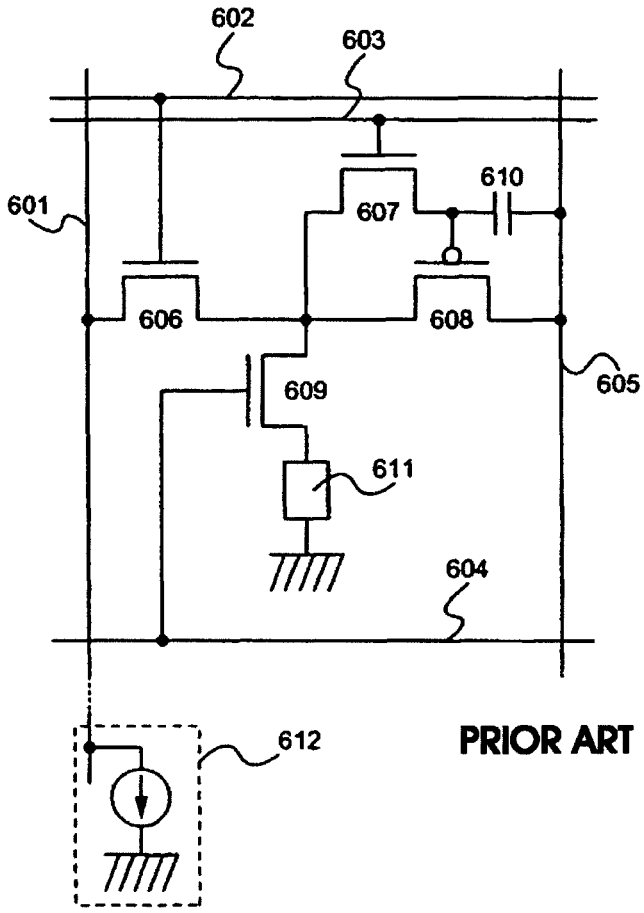
FIG. 6 is a diagram showing a configuration example of a conventional pixel.
Figure 7A:
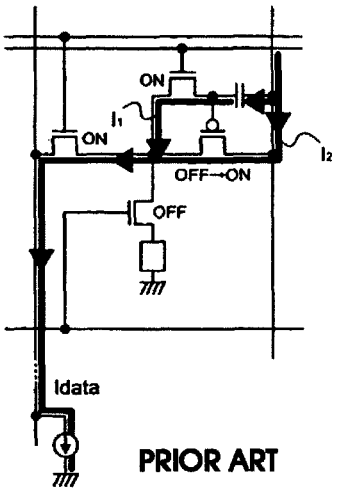
FIGS. 7A to 7E are diagrams showing operations of a conventional pixel.
Figure 7B:
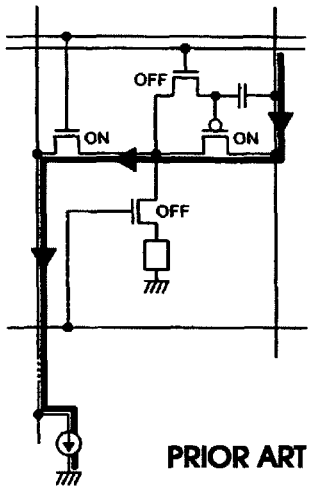
PRIOR ART FIG. 7B
Figure 7C:
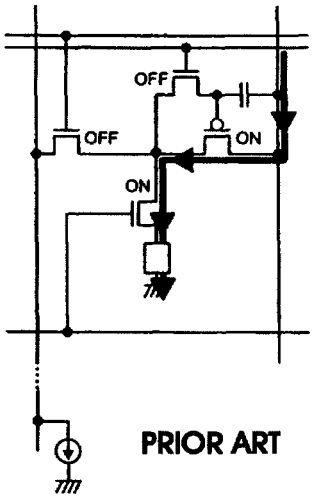
PRIOR ART FIG. 7C
Figure 7D:
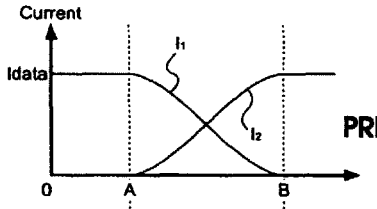
PRIOR ART FIG. 7D
Figure 7E:
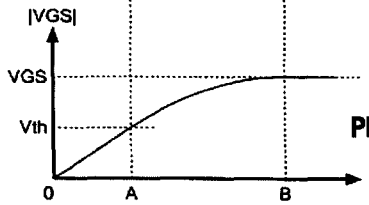
PRIOR ART FIG. 7E

Various configurations can be applied to the unit circuit. According to the present embodiment mode, a unit circuit using the similar circuit as FIG. 6 is shown in FIG. 2. A switching circuit 106 in a unit circuit 105 corresponds to the TFT 606 in FIG. 6. A current source circuit 107 in the unit circuit 105 comprises a current source transistor 208, a capacitor 210, and switches 207 and 209. A Load 201 is connected to the switch 209. The transistor 208 in the current source circuit 107 corresponds to the TFT 608 in FIG. 6, the capacitor 210 corresponds to the storage capacitor 610, and the switches 207 and 209 correspond to the TFTs 607 and 609 respectively. The load 201 corresponds to the EL element 611 in FIG. 6.

Figure 3:
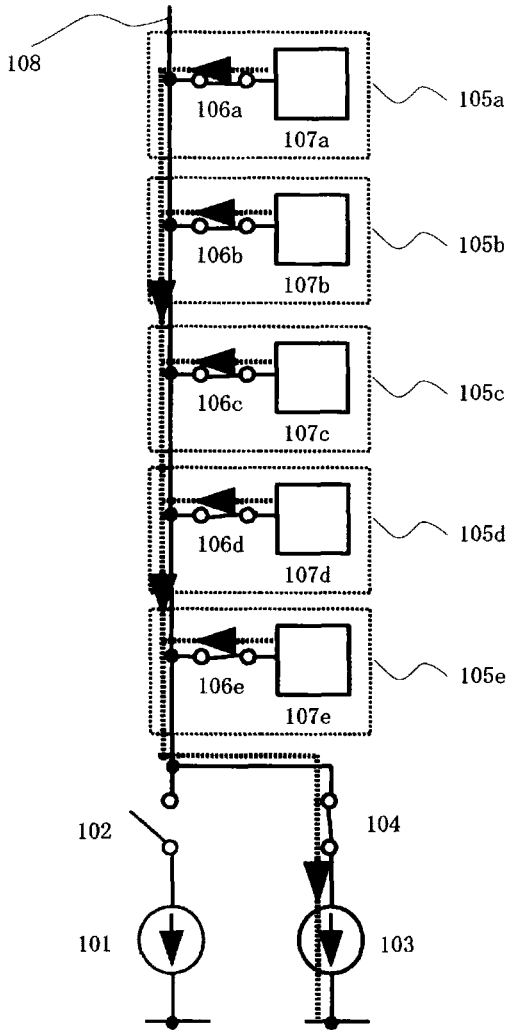
FIG. 3 is a diagram showing an operation of a semiconductor device of the invention.

Operation of the circuit shown in FIG. 1 is explained now. First, a pre-charge operation is performed as shown in FIG. 3. Current is supplied not only to a unit circuit to be input a signal, but also to the other unit circuits in the pre-charge operation. The size of the total current is increased according to the increased number of the unit circuits to be supplied current.

That is, the switch 104 is turned ON and the switch 102 is turned OFF so that current from the additional current source 103 flows. Then, each switch circuit in a plurality of the unit circuits is turned ON and the current starts to flow thereto. In FIG. 3, the switching circuits 106*a* to 106*e* are turned ON, thus current flows into the five unit circuits. Therefore, the current from the additional current source 103 is five times as large as that of the basic current source 101. In this manner, since a large current can be supplied to the circuit, the steady state is obtained quickly. In the pre-charge operation, a potential of the signal line 108 at which the steady state is obtained is referred to as Vp.

Note that during the pre-charge operation, the gate terminal and the drain terminal of the current source transistor in each current source circuit are preferably connected to each other. In FIG. 2, for example, the switch 207 is preferably turned ON. In addition, the switch 209 is preferably turned OFF to prevent current from flowing into the load 201 in FIG. 2. However, the invention is not limited to this.

Figure 4:
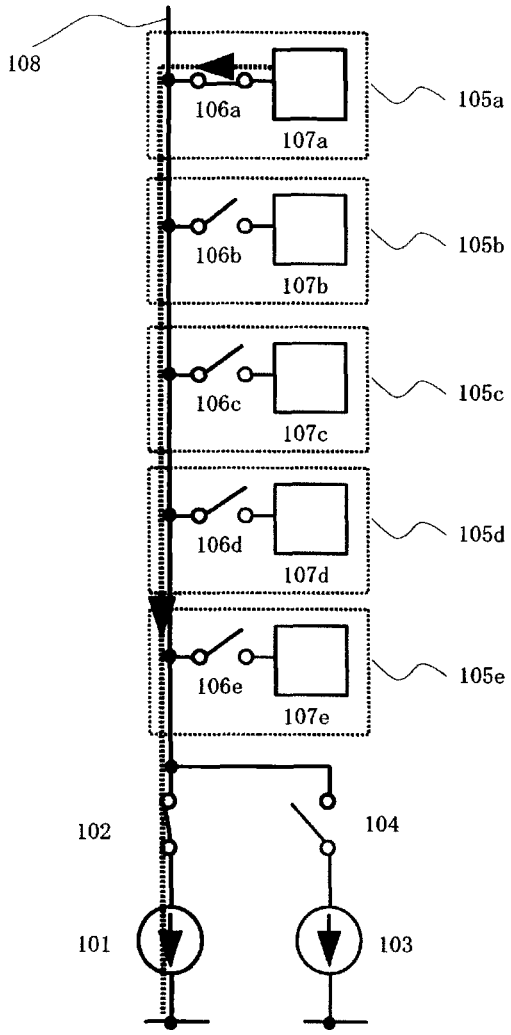
FIG. 4 is a diagram showing an operation of a semiconductor device of the invention.

Subsequently, as shown in FIG. 4, a setting operation is performed. It is assumed here that only the unit circuit 105*a* is to be input a signal. That is, current is supplied only to the unit circuit 105*a* while not to the unit circuits 105*b* to 105*e*. Therefore, the switching circuit 106*a* is turned ON while the switching circuits 106*b* to 106*e* are turned OFF. The switch 104 is turned OFF and the switch 102 is turned ON so that a current from the basic current source 101 flows. However, it has taken long time until the steady state is obtained conventionally since the current from the basic current source 101 is quite small. While in the case of FIG. 4, since a pre-charge operation is performed prior to a setting operation, the potential of the signal line 108 is equal to Vp. The potential Vp is nearly equal to the potential of the signal line 108 at the completion of the setting operation. Consequently, it makes possible to complete the setting operation and reach the steady state quickly.

As described above, large current is supplied in the pre-charge operation (pre-charge period). For example, when a current of A times as large is supplied, it is supplied to A-pieces of unit circuits. With this large current, the steady state can be obtained quickly. In other words, the influence due to a parasitic load on a wiring flowing current (wiring resistance, cross capacitance, etc) can be reduced and the steady state is thus obtained quickly. In the subsequent setting period, a current of one time as large is supplied to one unit circuit to perform the setting operation. However, the potential of the wiring flowing current is nearly equal to the one at the completion of the setting operation. This is because the magnification (A times) of current in the pre-charge operation corresponds to the number (A) of the unit circuits to which the current is supplied. As described above, the pre-charge operation enables the quick completion of the setting operation.

Therefore, when the load 201 is an EL element for example, a signal can be written quickly even in the case of writing signals for a light emission of the EL element with low gradation, that is to say, even with the small current supply in the setting operation.

In addition, a potential of a signal line at the completion of the pre-charge operation is nearly equal to the one at the completion of the setting operation. When they are exactly equal to each other, it means that the setting operation is completed simultaneously with the completion of the pre-charge operation. On the other hand, when they are not exactly equal to each other, the potential difference is controlled according to the setting operation. Therefore, variations in potentials at a signal line can be suppressed small from the start to the completion of the setting operation, thus it becomes possible to obtain the steady state quickly.

It depends on the variation in current characteristics of each current source transistor in the current source circuits 107*a* to 107*e* whether the potential of a signal line at the completion of the pre-charge operation is equal or not to the one at the completion of the setting operation. When the current characteristics do not vary, the voltage between the gate and the source of the current source transistor in the pre-charge operation is equal to that of the setting operation. However, when the current characteristics vary, the voltage between the gate and the source of the current source transistor in the pre-charge operation is different from that of the setting operation. Therefore, the potential of the signal line 108 is different at the completion of the pre-charge operation and at the completion of the setting operation. It is thus desirable that each current source transistor in the current source circuits 107*a* to 107*e* has uniformity in current characteristics. This makes it possible to obtain the steady state quickly in the setting operation. The uniformity in the current characteristics of the current source transistors can be obtained by irradiating semiconductor layers of each transistor with the same laser shot in crystallization.

Note that although five unit circuits are employed in FIG. 1, the number of unit circuits is not limited to this.

Figure 5:
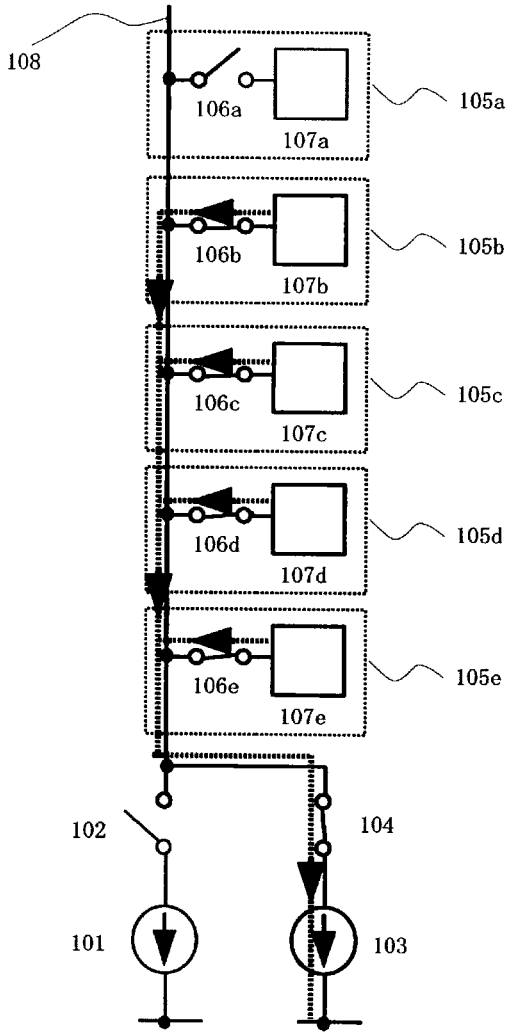
FIG. 5 is a diagram showing an operation of a semiconductor device of the invention.

Furthermore, although current is input to five unit circuits in FIG. 3 in the pre-charge operation, the invention is not limited to this. Current may be input to four unit circuits as shown in FIG. 5 for example. In this case, the current of the additional current source 103 is preferably four times as large as that of the basic current source 101. In addition, although the switching circuits 106*b* to 106*e* are ON and the switching circuit 106*a* is OFF in FIG. 5, the invention is not limited to this. Since it is assumed that only the unit circuit 105*a* is to be input a signal, current is preferably input to the unit circuit 105*a* in the pre-charge operation in view of variations in current characteristics of a transistor. However, as shown in FIG. 5, the pre-charge operation may be performed with the switching circuit 106*a* being OFF so that current is not input to the unit circuit 105*a*.

Although current is input to one unit circuit in FIG. 4 in the setting operation, the invention is not limited to this. For example, current may be input to a plurality of unit circuits. In this case, the current size of the base current source 101 needs to be increased according to the number of the unit circuits.

In addition, although the signal line 108 is connected to each of the current source circuits 107*a* to 107*e* through the respective switch circuits 106*a* to 106*e* in FIG. 1, the invention is not limited to this. Any configuration can be adopted as far as it can control the selection of a current input to each of the unit circuits 105*a* to 105*e* from the signal line 108. Although a current is input to each unit circuit through the signal line 108 in FIG. 1, alternative signals such as voltage may be input to the unit circuit as well by using another wiring for example.

Although the switch 102 is turned OFF and the switch 104 is turned ON in the pre-charge operation in FIG. 3, the invention is not limited to this. Current may be supplied from both the basic current source 101 and the additional current source 103 by turning ON the switch 102 if the current size is controlled.

In FIG. 1, the signal line 108 is connected to the basic current source 101 through the switch 102 and to the additional current source 103 through the switch 104 for ease of description, however, the invention is not limited to this. Any configuration can be adopted as far as it can control the current size to be supplied to the signal line 108 in the pre-charge operation and in the setting operation. Thus, the switches 102 and 104 may be disposed in any position as far as they can control the current size supplied from the basic current source 101 and the additional current source 103. When each of the basic current source 101 and the additional current source 103 has a function of switching the current output, the switches 102 and 104 may be omitted. In addition, the basic current source 101 and the additional current source 103 may be integrated into one current source if they have a function of switching the current size between the pre-charge operation and the setting operation.

Figure 8:
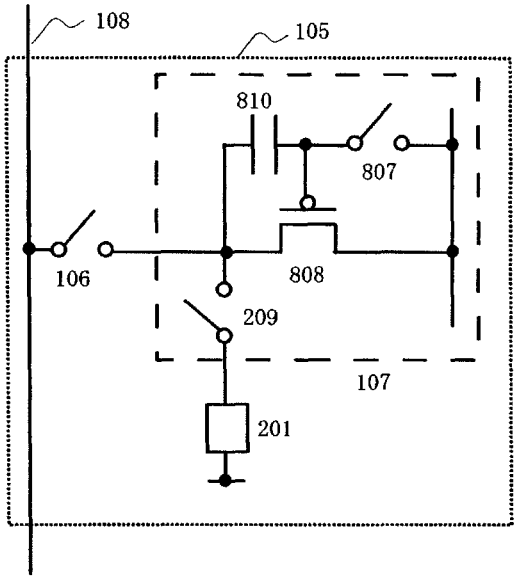
FIG. 8 is a diagram showing a configuration example of a unit circuit of the invention.

In addition, although current flows from the unit circuit to the basic current source 101 or the additional current source 103 in FIGS. 1 to 4, the invention is not limited to this. Current may flow from the basic current source 101 and the additional current source 103 to the unit circuit. However, in that case, the current source circuit in each unit circuit has to be taken into consideration. When employing the configuration of the current source circuit as shown in FIG. 2 for example, it is necessary to change the polarity of the current source transistor 208 from P-channel type to N-channel type. This is because the source terminal and the drain terminal of the transistor are switched corresponding to the direction of a current flow. In the case where a current flows from the basic current source 101 or the additional current source 103 to the unit circuit, and the polarity of the current source transistor is P-channel type, the configuration shown in FIG. 8 has to be employed. In FIG. 8, a capacitor 810 is connected between the gate and the source of a current source transistor 808. Since the current size flowing in the transistor is determined by the voltage between the gate and the source of the transistor, the voltage between the gate and the source of the transistor needs to be stored. Therefore, the capacitor 810 is desirably connected between the gate and the source of the current source transistor 808. Further, a switch 807 is connected between the gate and the drain of the current source transistor 808. In this manner, since the gate terminal and the source terminal of the transistor is determined according to the direction of a current flow, namely the potential level, the configuration of the circuit needs to be determined accordingly.

The load 201 in FIG. 2 or FIG. 8 may be any element or circuit such as a resistor, a transistor, an EL element, a light-emitting element other than the EL element, a current source circuit comprising a transistor, a capacitor and a switch, or a wiring which is connected to a circuit. Further, it may be a signal line, or a signal line which is connected to a pixel. Incidentally, the pixel may include any display element such as an EL element or an element used for an FED (Field Emission Display). It may be a current source circuit in a signal driver circuit for supplying a current to a pixel as well.

The capacitor 210 in FIG. 2 or the capacitor 810 in FIG. 8 may be substituted for the gate capacitor of the current source transistors 208 and the like, and in that case, the capacitors 210 and 810 can be omitted.

Although the capacitor 210 is connected to the gate terminal and the source terminal of the current source transistor 208, the invention is not limited to this. It is most desirable that the capacitor 210 is connected between the gate terminal and the source terminal of the current source transistor 208. This is because the operation of the transistor is determined by the voltage between the gate and the source, and thus when storing a voltage between the gate terminal and the source terminal, the transistor is unlikely to suffer from the other influence (such as a voltage drop due to the wiring resistance). If the capacitor 210 is disposed between the gate terminal of the current source transistor 208 and the other wiring, the potential at the gate terminal of the current source transistor 208 may be changed due to the voltage drop in the wiring.

Although five current source circuits 107*a* to 107*e* are shown in FIG. 1, the current capacity of each current source circuit, namely the gate width W and the gate length L of each current source transistor may be the same or different among all the unit circuits. When the current capacity of each current source is different among the unit circuits, it is necessary that the potential at the signal line 108 at the point when the steady state is obtained is set to be nearly equal to each other in the pre-charge operation and the setting operation.

The switch shown in FIG. 1 and the like may be any switch such as an electrical switch or a mechanical switch. It may be any element or circuit as far as it can control a current flow. It may be a transistor, a diode, or a logic circuit comprising them. Therefore, in the case of using a transistor as a switch, a polarity thereof (conductivity) is not particularly limited because it operates just as a switch. However, when OFF current is preferred to be small, a transistor of a polarity with small OFF current is favorably used. For example, the transistor which provides an LDD region has small OFF current. Further, it is desirable that an n-channel transistor is employed when a potential at a source terminal of the transistor as a switch is closer to the power source potential on the low potential side (Vss, Vgnd, 0V and the like), and a p-channel transistor is employed when the potential at the source terminal is closer to the power source potential on the high potential side (Vdd and the like). This helps the switch operate efficiently as the absolute value of the voltage between the gate and source of the transistor can be increased. It is also possible to employ a CMOS switch by using both n-channel and p-channel transistors.

The circuit configuration of the invention is not limited to those shown in FIGS. 1, 2 and 8. Various circuit configurations are provided by changing the number of unit circuits, the number of current sources, the number and the configuration of switches, the polarity of each transistor, the number and the configuration of current source transistors, the potential of each wiring, the direction of a current flow, and the like. Also, by combining these changes, a further variety of circuit configurations can be provided.

In the case of FIG. 1, the pre-charge operation is performed as shown in FIG. 3 or FIG. 5 and subsequently, the setting operation is performed as shown in FIG. 4, however, the invention is not limited to this.

Figure 9:
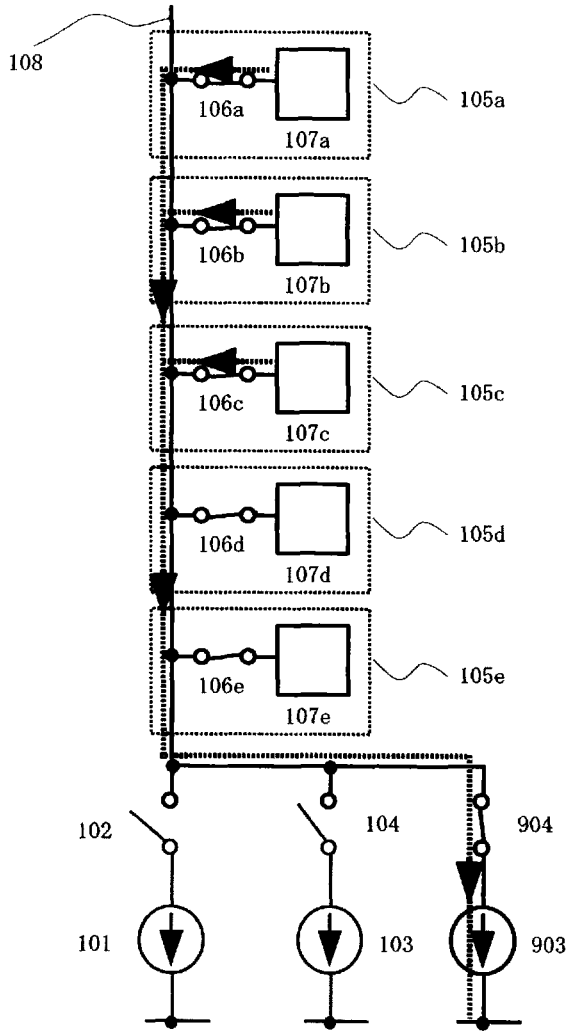
FIG. 9 is configuration diagram of a semiconductor device of the invention.

For example, the pre-charge operation such as shown in FIG. 3 or FIG. 5 may be performed a plurality of times. For example, in the first pre-charge operation, the current size five times as large is input to five unit circuits as shown in FIG. 3, and in the second pre-charge operation, the current size three times as large is input to three unit circuits as shown in FIG. 9. Finally, the current size one time as large is input to one unit circuit as the setting operation.

By performing the pre-charge operation a plurality of times in this manner, the subsequent setting operation can proceed efficiently.

Alternatively, other pre-charge operation may be combined.

Figure 10:
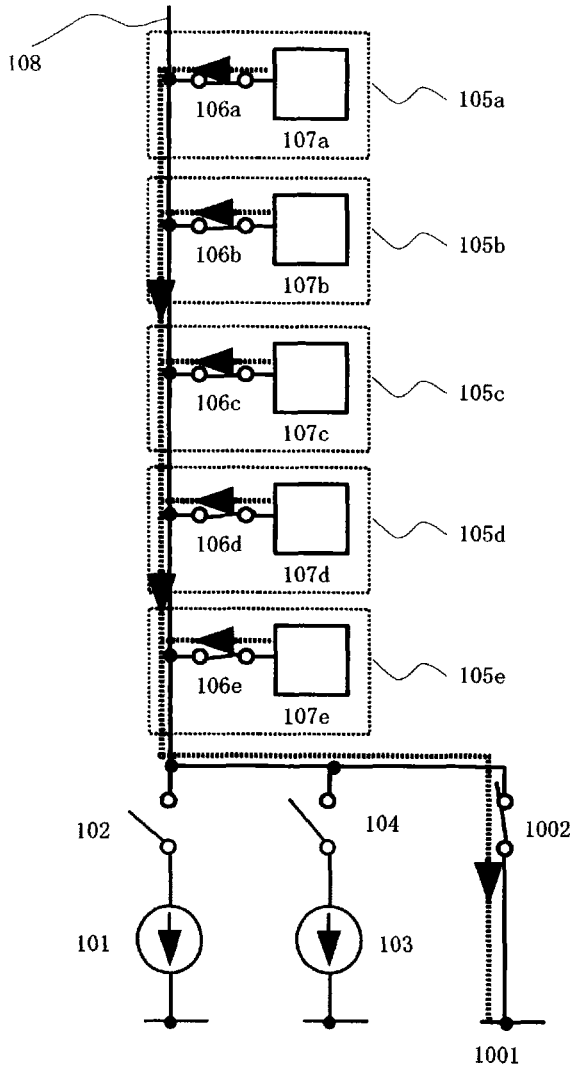
FIG. 10 is configuration diagram of a semiconductor device of the invention.

For example, as shown in FIG. 10, another pre-charge operation may be performed prior to the pre-charge operation as shown in FIG. 3. In FIG. 10, a voltage is supplied from a terminal 1001 through a switch 1002. The potential is set to be nearly equal to the potential at which the steady state is obtained in the pre-charge operation and the setting operation. That is, as shown in FIG. 10, the switch 1002 is turned ON to supply the potential at the terminal 1001. By applying a voltage, a large current can flow instantaneously, thus the pre-charge operation can be performed quickly. Subsequently, the switch 1002 is turned OFF to perform the pre-charge operation as shown in FIG. 3. Note that the technology of a pre-charge operation with a voltage supply is disclosed in Japanese Patent Application No. 2003-019240 by the same applicant. Various pre-charge technologies are disclosed in it and the content thereof may be combined with the invention.

Figure 11:
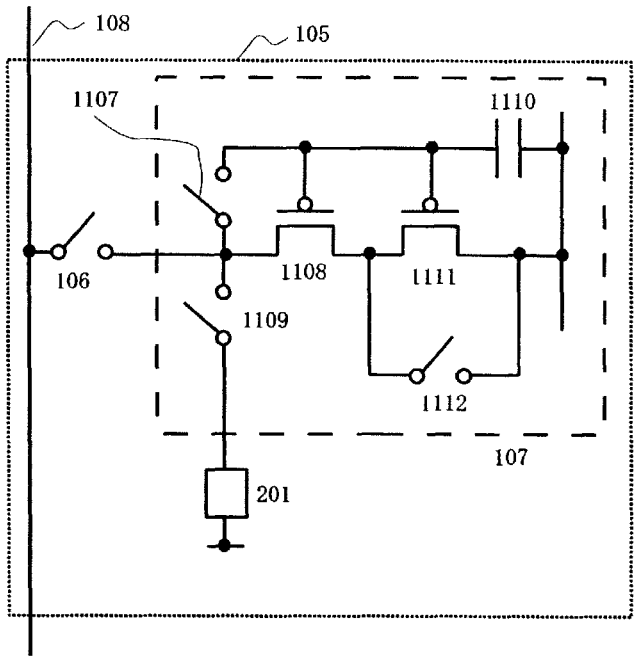
FIG. 11 is a diagram showing a configuration example of a unit circuit of the invention.
Figure 12:
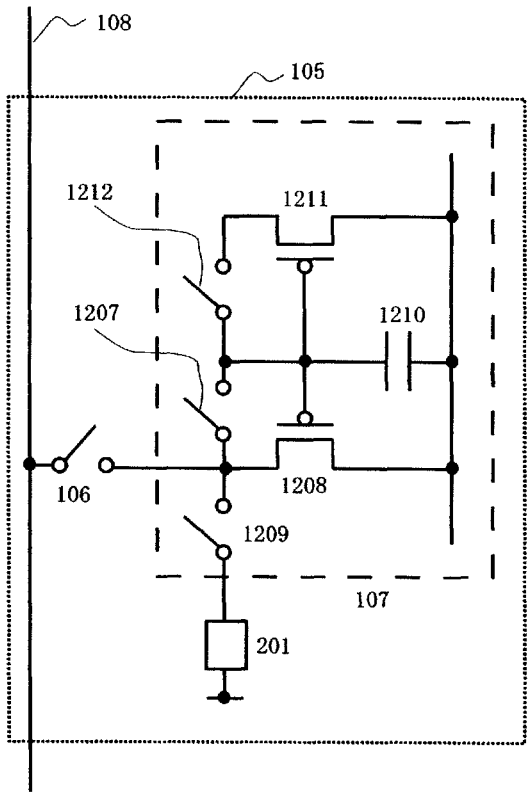
FIG. 12 is a diagram showing a configuration example of a unit circuit of the invention.

In addition, a pre-charge operation in which the current size flowing in each unit circuit (current source circuit) is changed through a plurality of steps for example, may be combined with the pre-charge circuit such as shown in FIG. 3. FIGS. 11 and 12 each show the configurations in which the current flowing in the current source circuit 107 can be changed to plural levels.

In the case of FIG. 11, a second current source transistor 1111 is connected in series to a current source transistor 1108. In addition, a switch 1112 for short-circuiting the source and the drain of the second current source transistor 1111 is disposed. When the switch 1112 is OFF, each of the current source transistor 1108 and the second current source transistor 1111 serves as a multi-gate transistor since the gate terminals of the current source transistor 1108 and the second current source transistor 1111 are connected to each other. The gate length L of the multi-gate transistor is larger than that of the current source transistor 1108, thus the current size flowing in the multi-gate transistor is small. On the other hand, when the switch 1112 is ON, no current flows between the source and the drain of the second current source transistor 1111 since they are short-circuited. That is, only the current source transistor 1108 operates in practice. In this manner, the current size flowing in the current source transistor 1108 can be changed by turning ON/OFF the switch 1112. By performing this operation before and after or during the operation as shown in FIG. 3 or 4, the more quick pre-charge operation is achieved.

In FIG. 12, a second current source transistor 1211 is connected in parallel to a current source transistor 1208 although they are connected in series to each other in FIG. 11. In this case also, when a larger current is to be supplied to the current source circuit 107, current can flow into the second current source transistor 1211 by turning ON a switch 1212.

Note that the configuration in which the current flowing in the current source circuit 107 is changed to plural levels as shown in FIGS. 11 and 12 is disclosed in Japanese Patent Application No. 2003-055018 by the same applicant. Various configurations are disclosed in it and the content thereof may be combined with the invention.

It is desirable that the transistor used in the pre-charge operation and the transistor used in the setting operation have the uniform characteristics as possible. In the case of FIG. 1 for example, it is desirable that the current source transistors 208, 808, 1108, 1208 and the second current source transistors 1111 and 1211 in the current source circuits 107*a* to 107*e* all have the uniform current characteristics. Therefore, in the formation step of the current source transistor and the second current source transistor, it is desirable to impart the uniformity in current characteristics of each transistor as possible. For example, in the case of irradiating a laser to semiconductor lasers of the current source transistor and the second current source transistor, the laser is desirably irradiated so that the current source transistor and the second current source transistor have the uniform current characteristics. Therefore, in the case of irradiating a linear laser, it is preferable to irradiate the laser in parallel with the signal line 108 and scan the laser in the perpendicular direction to the signal line 108.

Note that in the case of configuring each of the basic current source 101 and the additional current source 103 with a transistor which operates in a saturation region, each gate electrode is desirably connected to each other. In addition, the current size of each current source is desirably controlled by adjusting the ratio of the gate width W to the gate length L of each transistor.

As described above, various circuit configurations are provided according to the invention by changing the number and the configuration of switches, the polarity of each transistor, the number and the configuration of current source transistors, the type, the number and the configuration of basic current sources, the number and the configuration of unit circuits, the configuration of a current source circuit in the unit circuit, the number of pre-charge operations, the combination or non-combination with another pre-charge method, the direction of a current flow and the like. Also, by combining these changes, a further variety of circuit configurations can be provided.

Embodiment Mode 2

Described in Embodiment Mode 1 with reference to FIGS. 1 to 4 is the case where a unit circuit to be input a signal, namely a unit circuit to perform a setting operation is the unit circuit 105*a*. Described in the present embodiment mode is the operation in which the unit to perform a setting operation is changed sequentially with time.

Although the operation is described here using the configuration shown in FIG. 1, the configuration and the operation are not limited to them. In addition, Embodiment Mode 1 can be combined with the present embodiment mode.

It is assumed that the number of unit circuits to be input a signal in the pre-charge operation is three for ease of description, however, the number of unit circuits to be input a signal in the pre-charge operation is not limited to this.

Figure 13:
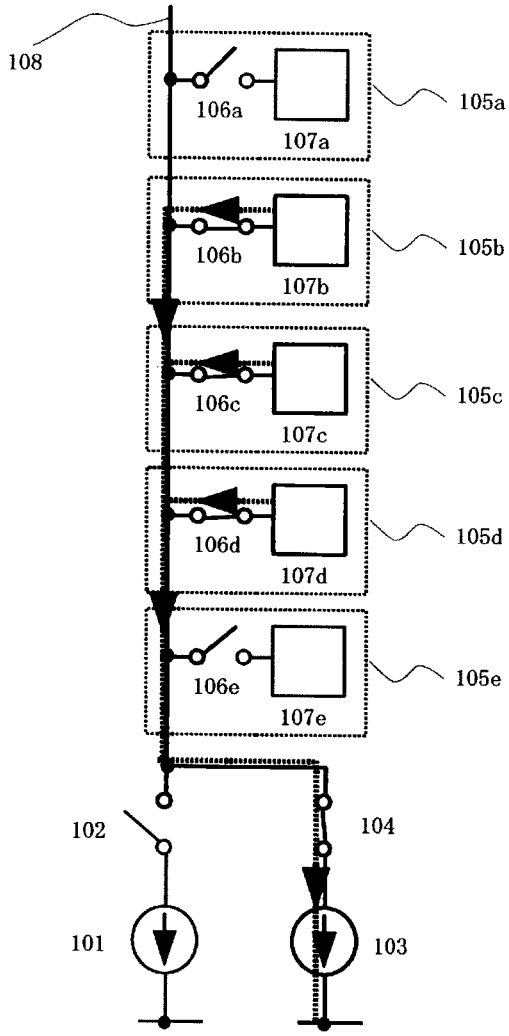
FIG. 13 is a diagram showing an operation of a semiconductor device of the invention.

First, it is assumed here that a unit circuit to be input a signal, namely a unit circuit to perform a setting operation is the unit circuit 105*a*. A pre-charge operation is performed to the unit circuit 105*a* before a setting operation. The pre-charge operation is performed by flowing a current to three unit circuits for ease of description here. Therefore, as shown in FIG. 13, the pre-charge operation is performed by flowing a current to the unit circuits 105*b*, 105*c*, and 105*d*.

The reason why the unit circuits 105*b*, 105*c*, and 105*d* are input current as a pre-charge operation to the unit circuit 105*a* before a setting operation is as follows: the first unit circuit to be performed a setting operation is the unit circuit 105*a*, the second unit circuit is the unit circuit 105*b*, the third unit circuit is the unit circuit 105*c*, and the fourth unit circuit is the unit circuit 105*d*. That means, depending on the configuration, the state of a unit circuit may be changed when a setting operation is performed after a current is input to the unit circuit as a pre-charge operation. Therefore, a current may be supplied as a pre-charge operation if a setting operation is performed immediately after that.

On the other hand, in the case where the state of a unit circuit is not changed even when a setting operation is performed after a current is input to the unit circuit as a pre-charge operation, the pre-charge operation may be performed by using the unit circuit other than the unit circuits 105*b*, 105*c*, and 105*d*.

It is preferable that the state of the signal line 108 be not changed between the setting operation and the pre-charge operation. For this, a unit circuit (a current source circuit) for setting operation and a unit circuit (a current source circuit) for pre-charge operation desirably have the uniform current characteristics. Therefore, it is desirable that the pre-charge operation be performed by using a unit circuit disposed close to the unit circuit 105*a* (that is a unit circuit to perform the setting operation). It is needless to mention that the pre-charge operation may be performed by using the unit circuit 105*a* (that is the unit circuit to perform the setting operation).

As described above, in the case where the state of a unit circuit changes when the setting operation is performed after a current is supplied to the unit circuit as the pre-charge operation, a unit circuit for performing the setting operation is preferably selected after the pre-charge operation. In the case where the state of a unit circuit is not changed when the setting operation is performed, a unit circuit disposed close to the unit circuit for performing the setting operation is preferably selected. However, the invention is not limited to this.

Figure 14:
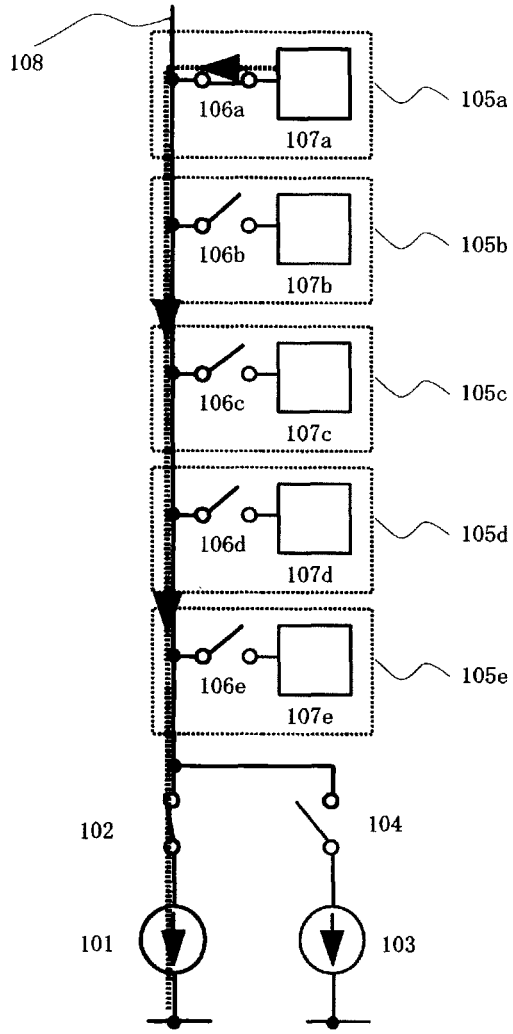
FIG. 14 is a diagram showing an operation of a semiconductor device of the invention.

Subsequently, the setting operation is performed to the unit circuit 105*a* as shown in FIG. 14 after the pre-charge operation as shown in FIG. 13.

Figure 15:
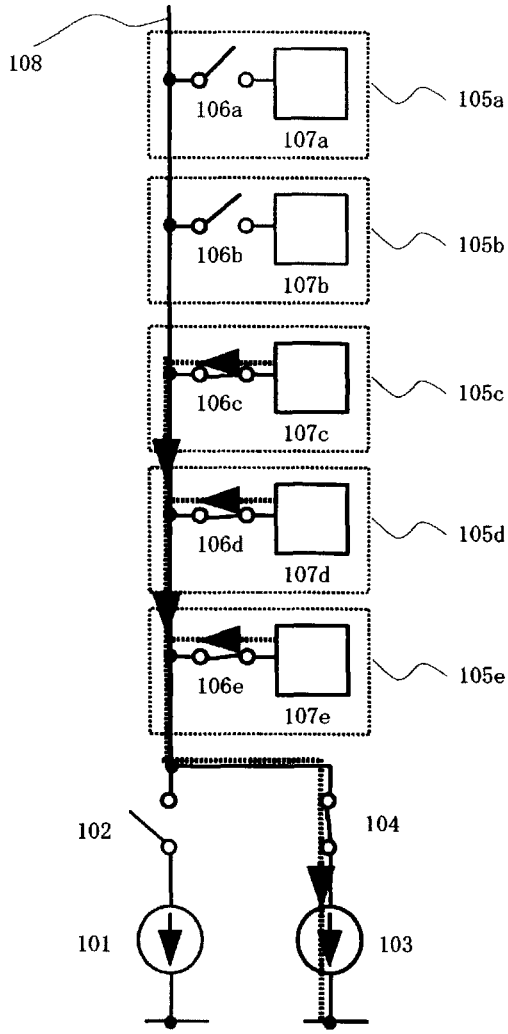
FIG. 15 is a diagram showing an operation of a semiconductor device of the invention.

Provided that a unit circuit to be inputted a signal, namely a unit circuit to perform the setting operation is now a unit circuit 105*b*, the pre-charge operation is performed before the setting operation is performed to the unit circuit 105*b*. The pre-charge operation is performed by flowing current to the unit circuits 105*c*, 105*d*, and 105*e* as shown in FIG. 15. Note that it is not preferable to flow a current to the unit circuit 105*a* as the pre-charge operation right after the setting operation.

Figure 16:
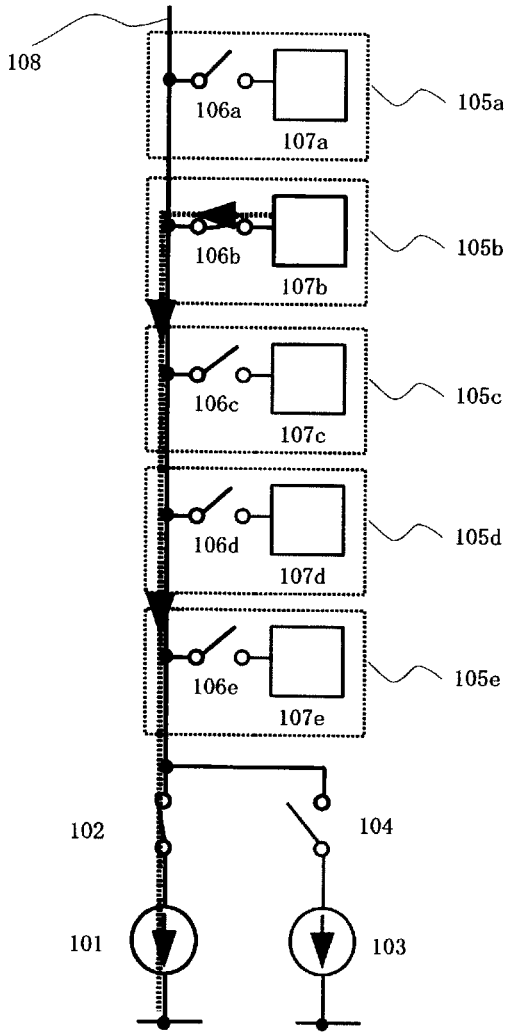
FIG. 16 is a diagram showing an operation of a semiconductor device of the invention.

Subsequently, the setting operation is performed to the unit circuit 105*b* as shown in FIG. 16.

Figure 17:
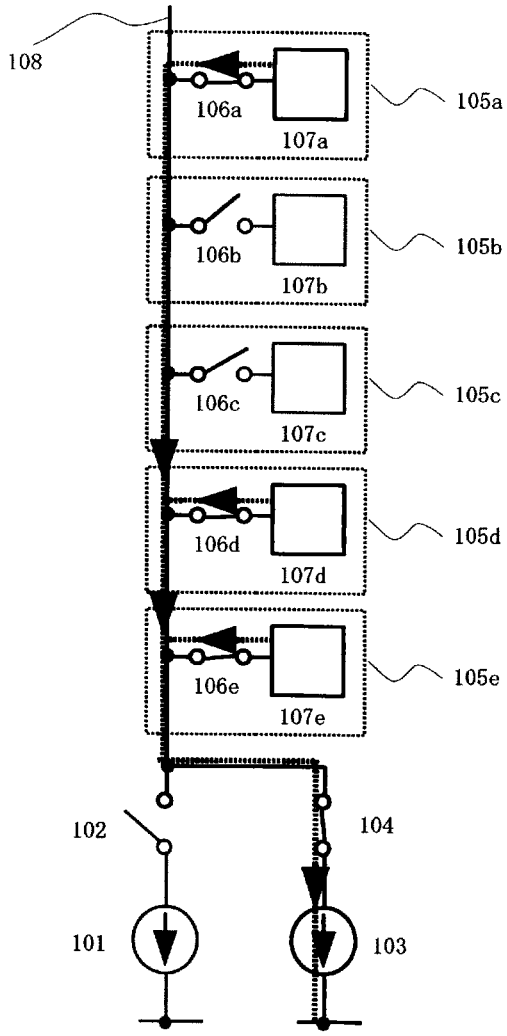
FIG. 17 is a diagram explaining an operation of a semiconductor device of the invention.
Figure 18:
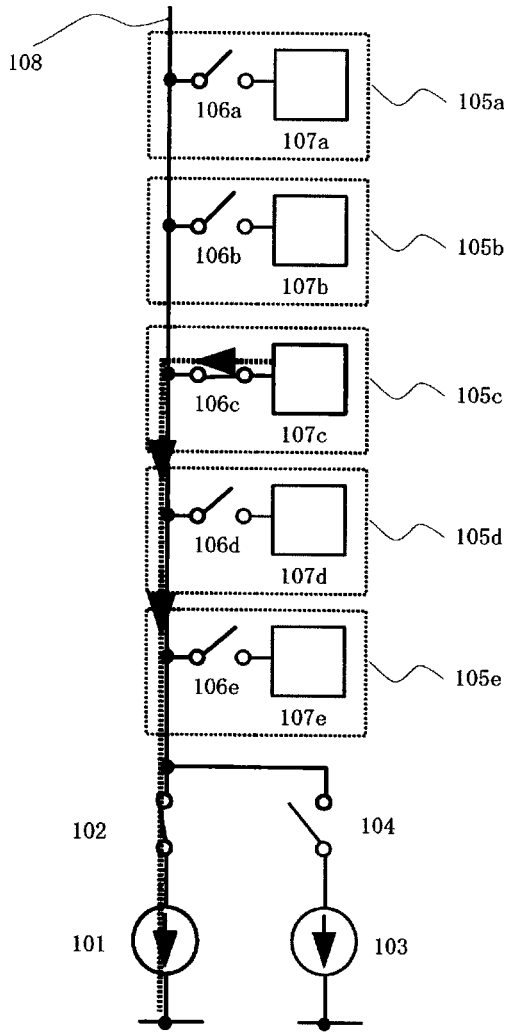
FIG. 18 is a diagram showing an operation of a semiconductor device of the invention.

As described above, a unit to perform the setting operation changes sequentially with time, thus the pre-charge operation and the setting operation are performed as shown in FIGS. 17 and 18.

Note that there is no unit circuit after the unit circuit 105*e* in the case of performing the pre-charge operation before the setting operation to the unit circuit 105*c*. In this case, the first unit circuit may flow a current as the pre-charge operation to the unit circuits 105*d*, 105*e*, and 105*a*. The operation at this time is shown in FIGS. 17 and 18.

Figure 19:
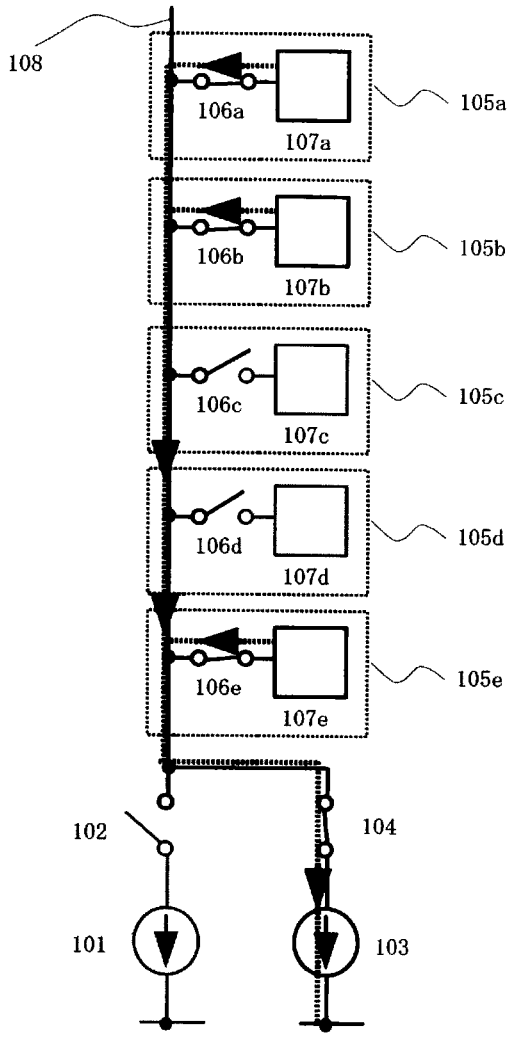
FIG. 19 is a diagram showing an operation of a semiconductor device of the invention.
Figure 20:
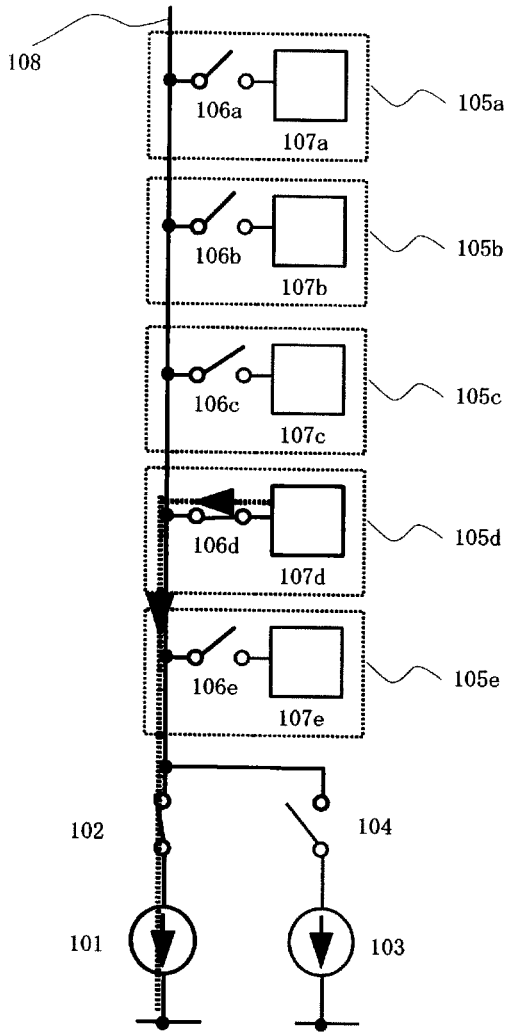
FIG. 20 is a diagram showing an operation of a semiconductor device of the invention.
Figure 21:
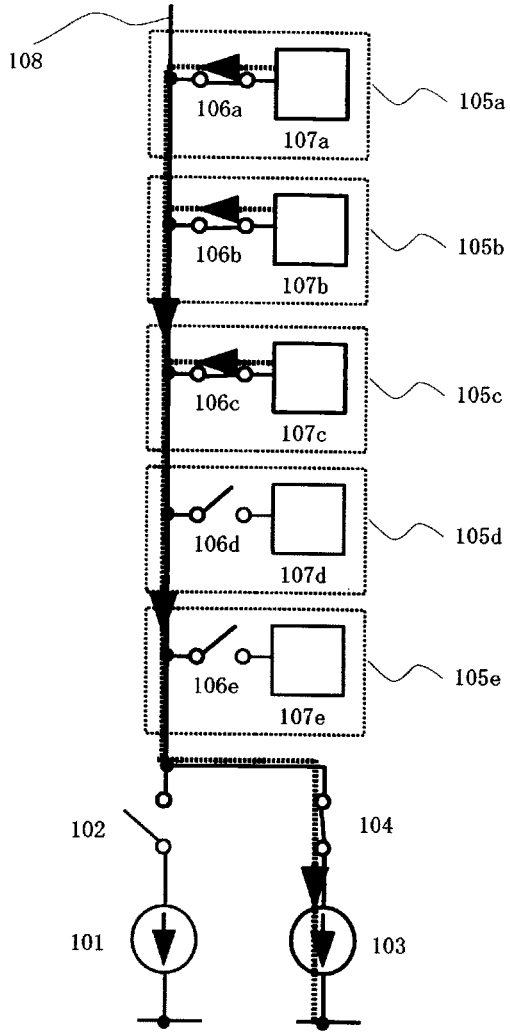
FIG. 21 is a diagram showing an operation of a semiconductor device of the invention.
Figure 22:
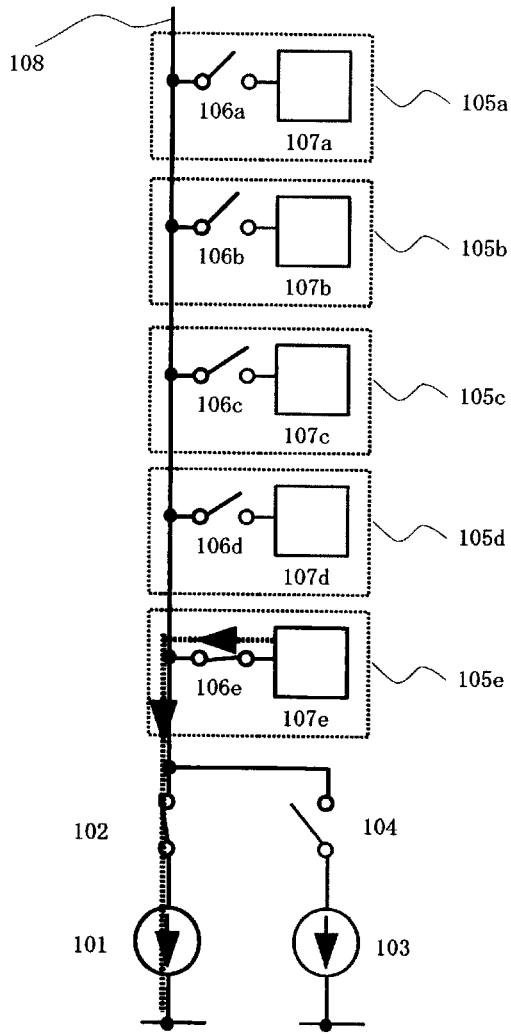
FIG. 22 is a diagram showing an operation of a semiconductor device of the invention.

Similarly, in the case of performing the setting operation to the unit circuit 105*d* after the time passed, the pre-charge operation is performed by flowing current to the unit circuits 105*e*, 105*a*, and 105*b* as shown in FIG. 19. After that, the setting operation is performed to the unit circuit 105*d* as shown in FIG. 20. The pre-charge operation and the setting operation are performed in the similar manner as shown in FIGS. 21 and 22.

By operating the circuit as described above, the setting operation can be performed to each unit circuit sequentially. By performing the pre-charge operation before the setting operation, the setting operation can be completed quickly even with a small current.

In the case of performing the pre-charge operation, a current flows to the unit circuits other than the unit circuit to perform the setting operation after the pre-charge operation, however, the invention is not limited to this. For example, in the case of performing the setting operation to the unit circuit 105*a* as shown in FIG. 14, a current may flow in the preceding pre-charge operation to the unit circuit 105*a* as well which is performed the setting operation as shown in FIG. 21, not as in FIG. 13.

Note that described in this embodiment mode corresponds to the detailed description of a certain operation based on the configuration described in Embodiment Mode 1, however, the invention is not limited to this. Therefore, various changes will be possible unless otherwise such changes depart from the scope of the content. Thus, the Embodiment Mode 1 can be applied to this embodiment mode as well.

Embodiment Mode 3

As shown in FIGS. 2, 8, 11, 12 and the like in Embodiment Mode 1, various configurations can be employed for a unit circuit. In this embodiment mode, another example and an operation of a unit circuit are described.

Figure 23:
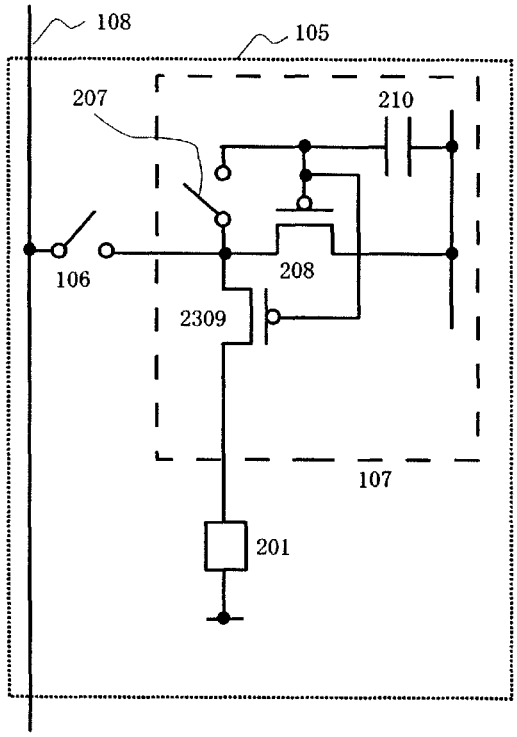
FIG. 23 is a diagram showing a configuration example of a unit circuit of the invention.

FIG. 23 shows an example of a circuit. In the case of the circuit shown in FIG. 23, a voltage between the gate and source of a transistor 2309 becomes zero when a switch 207 is turned ON. Therefore, a transistor 2309 is turned OFF and a current does not flow to the load 201. Thus, in the case of performing the pre-charge operation, the switches 106 and 207 may be turned ON. Note that in the case of the circuit shown in FIG. 23, when flowing a current to a unit circuit as a pre-charge operation, the state of the unit circuit changes when a setting operation is performed. Therefore, a current is not preferably supplied to the load after the pre-charge operation until a setting operation is performed. In such a case, the switch 207 may be turned ON when the switch 106 is turned OFF. When turning OFF the switch 106, a current does not flow to the unit circuit. On the other hand, a current does not flow to the load 201 since the switch 207 is ON. In the case of flowing a current to the load 201, the switches 106 and 207 may be turned OFF. Further, in the case of performing a setting operation, the switches 106 and 207 may be turned ON.

Figure 24:
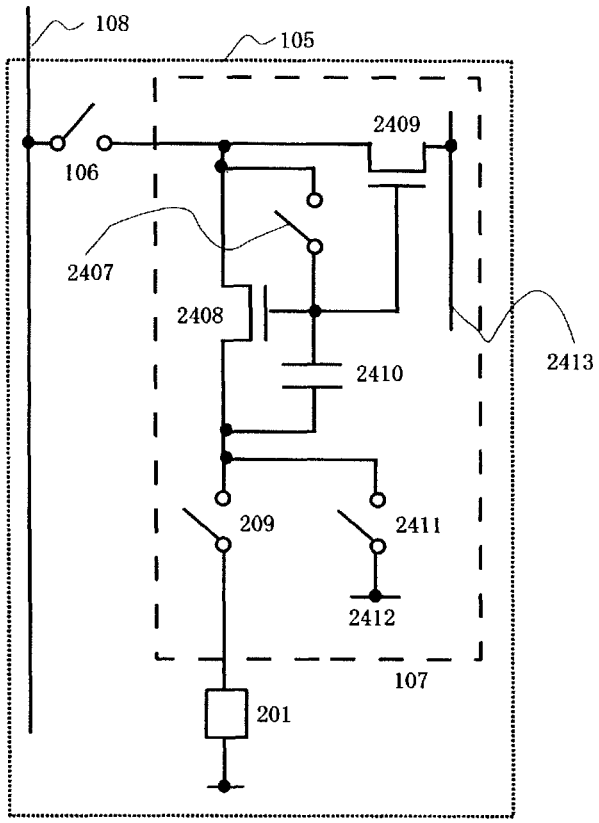
FIG. 24 is a diagram showing a configuration example of a unit circuit of the invention.

Another example is shown in FIG. 24. In the case of a circuit shown in FIG. 24, a voltage between the gate and source of a transistor 2409 becomes zero when a switch 2407 is turned ON. Therefore, the transistor 2409 is turned OFF and a current does not flow from a power supply line 2413 to the load 201. Therefore, the switches 106 and 2407 may be turned ON in the case of performing a pre-charge operation. However, a switch 2411 is required to be turned ON to flow a current to a wiring 2412 so as not to flow a current to the load 201. A current hardly flows to the load 201 when a potential of the wiring 2412 is controlled. However, in the case where a current still flows, a switch 209 may be turned OFF. In the case of a circuit shown in FIG. 24, the state of the unit circuit changes when a setting operation is performed after a current is supplied to the unit circuit as a pre-charge operation. Therefore, it is not preferable to flow a current to the load after the pre-charge operation until a setting operation is performed. Therefore, in such a case, the switch 106 may be turned OFF and the switch 2407 may be turned ON, otherwise the switch 209 may be turned OFF. By turning OFF the switch 106, a current does not flow to the unit circuit. Meanwhile, a current does not flow from the power supply line 2413 to the load 201 as the switch 2407 is turned ON. When flowing a current to the load 201, the switches 106, 2407, and 2411 may be turned OFF and the switch 209 may be turned ON. In the case of performing a setting operation, the switches 106, 2407, and 2411 may be turned ON.

Note that the configurations shown in FIGS. 23 and 24 are disclosed in Japanese Patent Application No. 2002-274680 by the same applicant. The content thereof can be combined with the invention.

Figure 25:
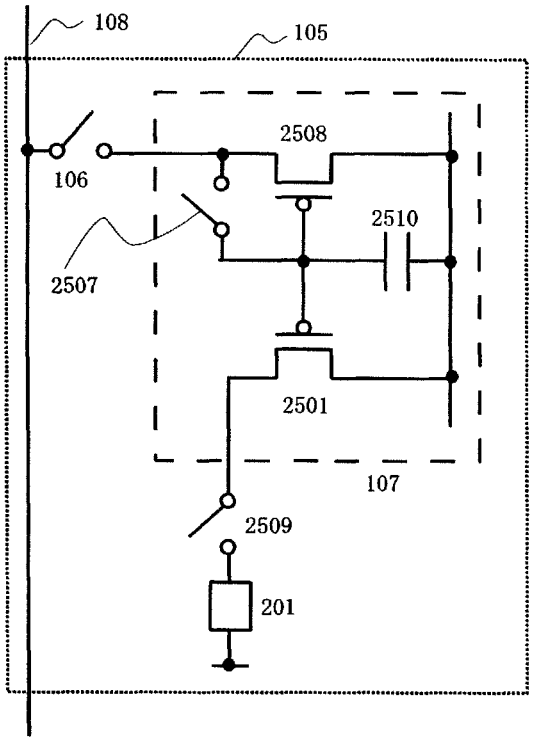
FIG. 25 is a diagram showing a configuration example of a unit circuit of the invention.
Figure 26:
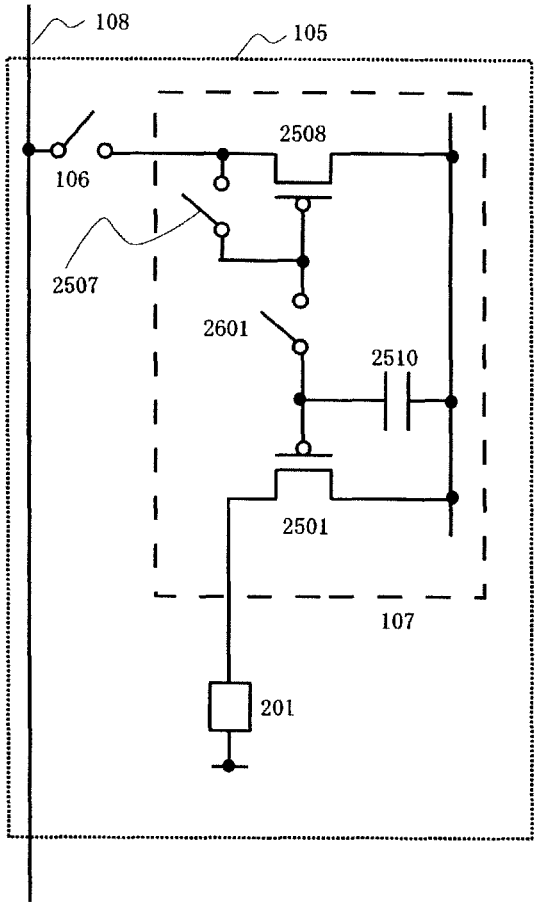
FIG. 26 is a diagram showing a configuration example of a unit circuit of the invention.

Examples in which a current mirror circuit is used are shown in FIGS. 25 and 26. In the case of FIG. 25, when flowing a current to a unit circuit as a pre-charge operation, the state of the unit circuit changes when a setting operation is performed. Therefore, a current flow to the load 201 is required to be controlled by using a switch 2509. In the case of FIG. 26, however, the state of a unit circuit does not change when a setting operation is performed by turning OFF the switch 2601 even when a current is supplied to the unit circuit as a pre-charge operation. That is to say, a signal stored in a capacitor 2510 does not change. Therefore, a current can flow to the load 201 even when a pre-charge operation is performed.

Figure 27:
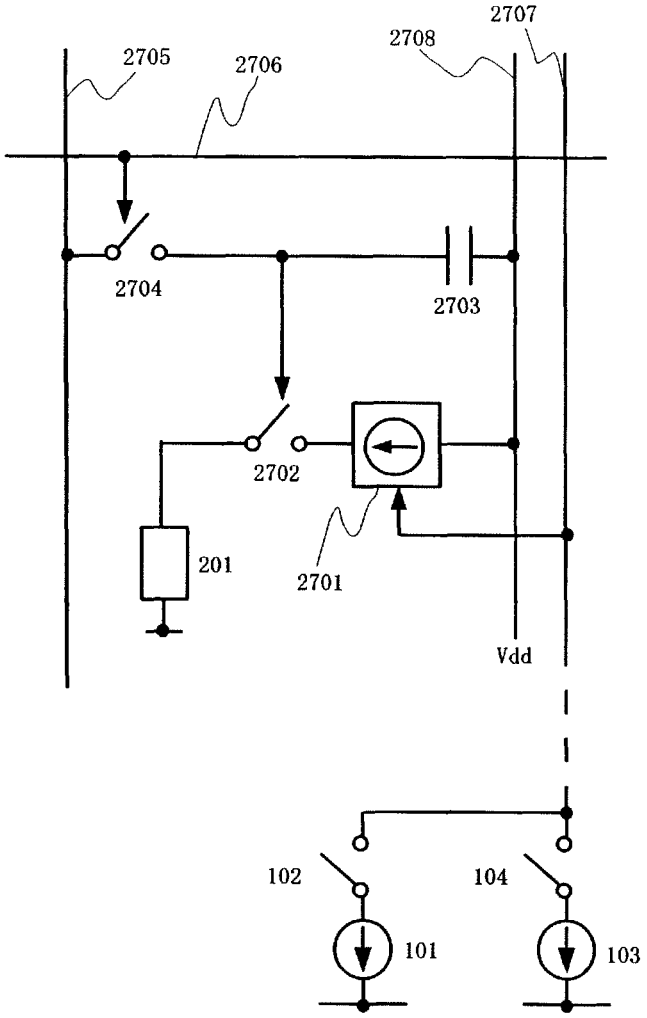
FIG. 27 is a diagram showing a configuration example of a unit circuit of the invention.
Figure 28:
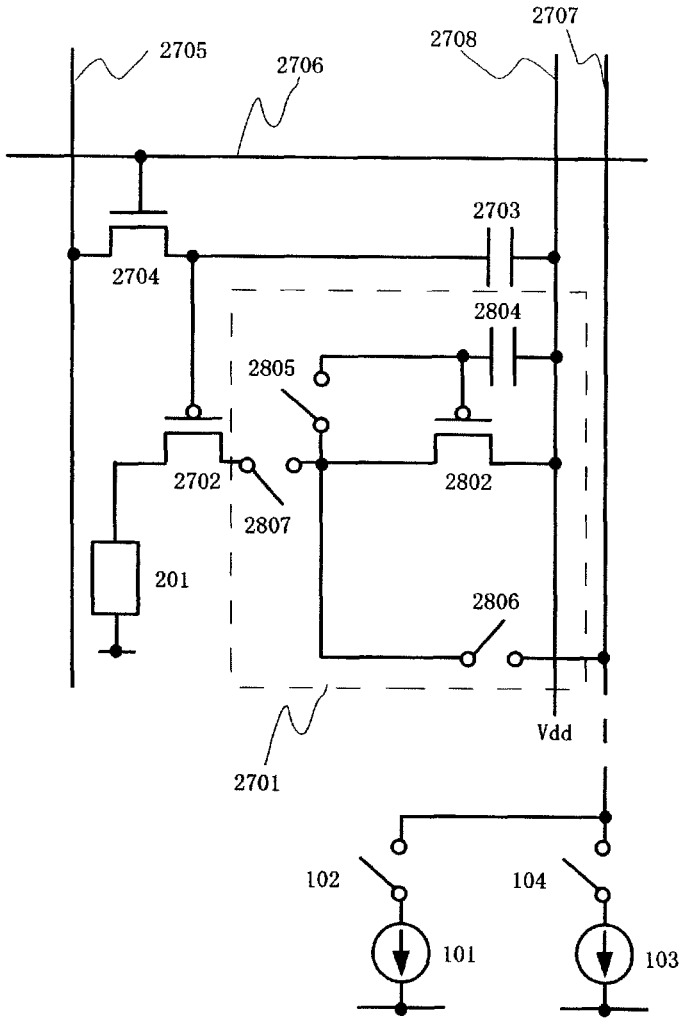
FIG. 28 is a diagram showing a configuration example of a unit circuit of the invention.

FIG. 27 shows another example. FIG. 28 shows a specific example of a circuit of FIG. 27. The configurations and operations thereof shown in FIGS. 27 and 28 are disclosed in International Publication No. 03/027997 pamphlet by the same applicant. The content thereof can be combined with the invention.

The unit circuits of various configurations have been described in this embodiment, however, the invention is not limited to this and various changes will be possible unless otherwise such changes depart from the scope of the content. Further, the content described in this embodiment mode can be freely combined with Embodiment Modes 1 and 2.

Embodiment Mode 4

Explained in this embodiment mode is the configuration and operation of a display device, a signal driver circuit and the like. The circuit of the invention can be applied to a part of the signal driver circuit and a pixel.

Figure 29:
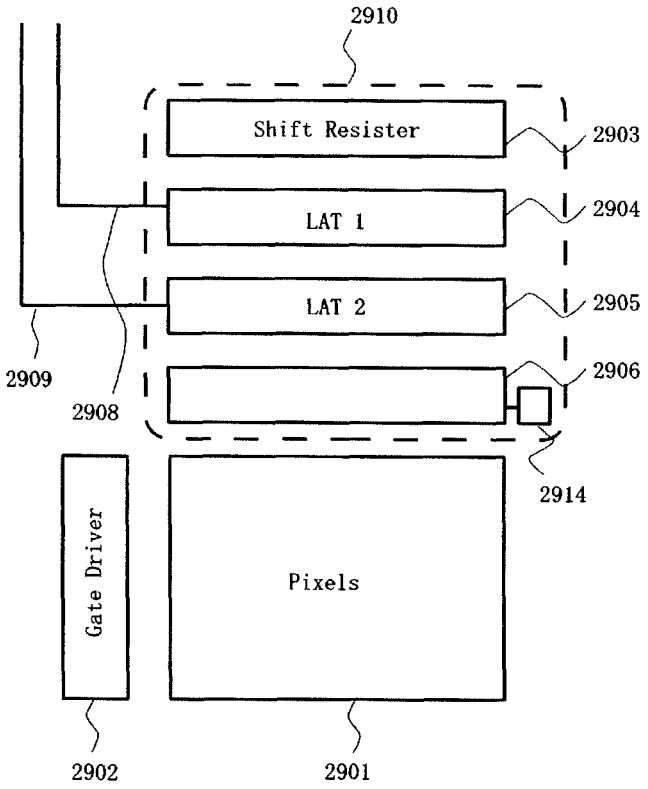
FIG. 29 is a diagram showing a configuration of a display device of the invention.

As shown in FIG. 29, the display device comprises a pixel array 2901, a gate driver circuit 2902 and a signal driver circuit 2910. The gate driver circuit 2902 sequentially outputs selection signals to the pixel array 2901. The signal driver circuit 2910 sequentially outputs video signals to the pixel array 2901. The pixel array 2901 displays an image by controlling the luminance according to a video signal. The video signal which is output from the signal driver circuit 2910 to the pixel array 2901 is a current in many cases. That is, the state of a display element disposed in each pixel and an element for controlling the display element are changed according to the video signal (current) which is input from the signal driver circuit 2910. The display element disposed in the pixel is typified by an EL element or an element used for an FED (Field Emission Display) and the like.

The number of the gate signal driver circuit 2092 and the signal driver circuit 2910 may be more than one.

The signal driver circuit 2910 can be divided into a plurality of units, for example, into a shift register 2903, a first latch circuit (LAT1) 2904, a second latch circuit (LAT2) 2905, and a digital-to-analog converter circuit 2906. The digital-to-analog converter circuit 2906 has a function for converting voltage into current, and it may be provided with a gamma compensation function as well. That is, the digital-to-analog converter circuit 2906 has a circuit which outputs current (video signal) to a pixel, namely a current source circuit, and the invention can be applied to this circuit.

The pixel comprises a display element such as an EL element, and the display element has a circuit which outputs current (video signal), namely a current source circuit. The invention can be applied to the current source circuit as well.

The operation of the signal driver circuit 2910 is explained in brief below. The shift register 2903 comprises a plurality of lines of flip flop circuits (FF) and the like, and a clock signal (S-CLK), a start pulse (SP) and a inverted clock signal (S-CLKb) are input. In accordance with the timing of these signals, sampling pulses are sequentially output.

A sampling pulse which is output from the shift register 2903 is input to the first latch circuit (LAT1) 2904. In the first latch circuit (LAT1) 2904, a video signal is input from a video signal line 2908 and a video signal is stored in each line in accordance with the timing at which the sampling pulse is input. The video signal has a digital value in the case of disposing the digital-to-analog converter circuit 2906. The video signal at this stage is generally a voltage signal.

However, the digital-to-analog converter circuit 2906 may be omitted in the case where the first latch circuit (LAT1) 2904 and the second latch circuit (LAT2) 2905 can store an analog value. In such a case, the video signal is frequently a current. Also, when the data which is output to the pixel array 2901 has a binary value, namely a digital value, the digital-to-analog converter circuit 2906 is omitted in many cases.

When the video signal storage is completed up to the last line in the first latch circuit (LAT1) 2904, a latch pulse (Latch Pulse) is input from a latch control line 2909 during a horizontal fly-back period and the video signals stored in the first latch circuit (LAT1) 2904 are transferred to the second latch circuit (LAT2) 2905 all at once. Subsequently, one row of the video signals stored in the second latch circuit (LAT2) 2905 is simultaneously input to the digital-to-analog converter circuit 2906. Then, the signals output from the digital-to-analog converter circuit 2906 are input to the pixel array 2901.

While the video signals stored in the second latch circuit (LAT2) 2905 are input to the digital-to-analog converter circuit 2906 and to the pixel array 2901, a sampling pulse is again output in the shift register 2903. That is, two operations are performed at the same time. Therefore, a line sequential drive is enabled. This operation is repeated in this manner.

Note that in the case where the current source circuit of the digital-to-analog converter circuit 2906 performs both the setting operation and output operation, the current source circuit is required to be provided with a circuit for outputting current. In such a case, a reference current source circuit 2914 is disposed.

Figure 30:
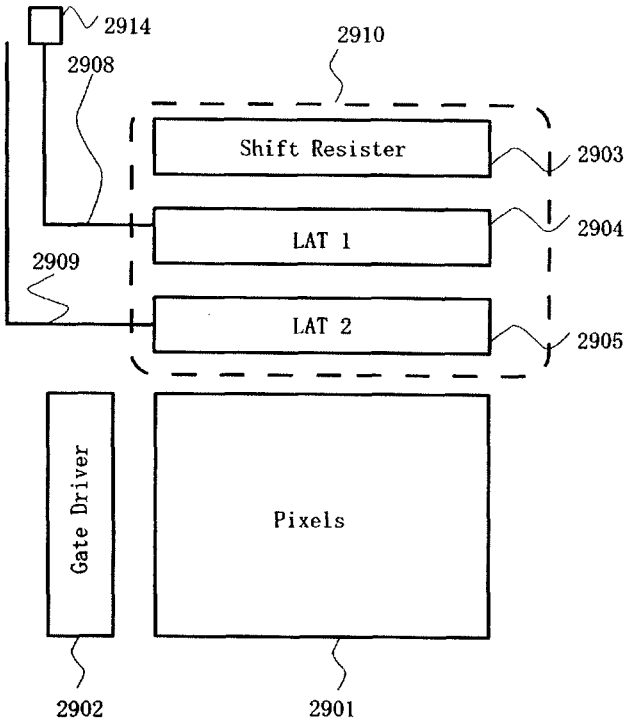
FIG. 30 is a diagram showing a configuration of a display device of the invention.

Also, according to the invention, the type of the transistors and the substrate onto which the transistors are formed are not limited as described above. Therefore, it is possible to form the whole circuit as shown in FIG. 29 or FIG. 30 on a glass substrate, a plastic substrate, a single crystal substrate or an SOI substrate. Incidentally, not all part of the circuit shown in FIG. 29 or FIG. 30 is necessarily formed on the same substrate and a part of the circuit may be formed on a different substrate. For example, in FIGS. 29 and 30, it is possible that the pixel array 2901 and the gate driver circuit 2902 are formed with TFTs on a glass substrate and the signal driver circuit 2910 (or part of it) is formed on a single crystal substrate, thereby connecting the IC chip onto the glass substrate with COG (Chip On Glass) bonding. In place of COG bonding, TAB (Tape Auto Bonding), a print substrate and the like may be used as well.

That is, the signal driver circuit and a part of it may not be formed on the same substrate as the pixel array 2901, and it may be configured with an external IC chip for example.

The configuration of the signal driver circuit and the like are not limited to the one shown in FIG. 29.

For example, in the case where the first latch circuit (LAT1) 2904 and the second latch circuit (LAT2) 2905 can store an analog value, a video signal (analog current) may be input from the reference current source circuit 2914 to the first latch circuit (LAT1) 2904 as shown in FIG. 30. The second latch circuit (LAT2) 2905 may not be provided in FIG. 30 in some cases. In such a case, the larger number of current source circuits are frequently disposed in the first latch circuit (LAT1) 2904.

For example, it is possible to dispose two current source circuits, one of them performs the setting operation and the other performs the normal operation. These functions may be switched as well. Consequently, the setting operation and the normal operation can be performed at the same time.

The specific configuration of the current source circuit is disclosed in the international publication No. 03/038793 to No. 03/038797 pamphlets and the like. They can be applied to the invention or combined with the configuration of the invention.

For example, the invention can be applied to the current source circuit in the digital-to-analog converter circuit 2906 in FIG. 29. The digital-to-analog converter circuit 2906 comprises many unit circuits and the reference current source circuit 2914 comprises the basic current source 101 and the additional current source 103.

The invention can be also applied to the current source circuit in the first latch circuit (LAT1) 2904 shown in FIG. 30. The first latch circuit (LAT1) 2904 comprises many unit circuits and the reference current source circuit 2914 comprises the basic current source 101 and the additional current source 103.

Also, the invention can be applied to the pixel (the current source in this pixel) in the pixel array 2901 in FIGS. 29 and 30. The pixel array 2901 comprises many unit circuits and the signal driver circuit 2910 comprises the basic current source 101 and the additional current source 103.

Figure 31:
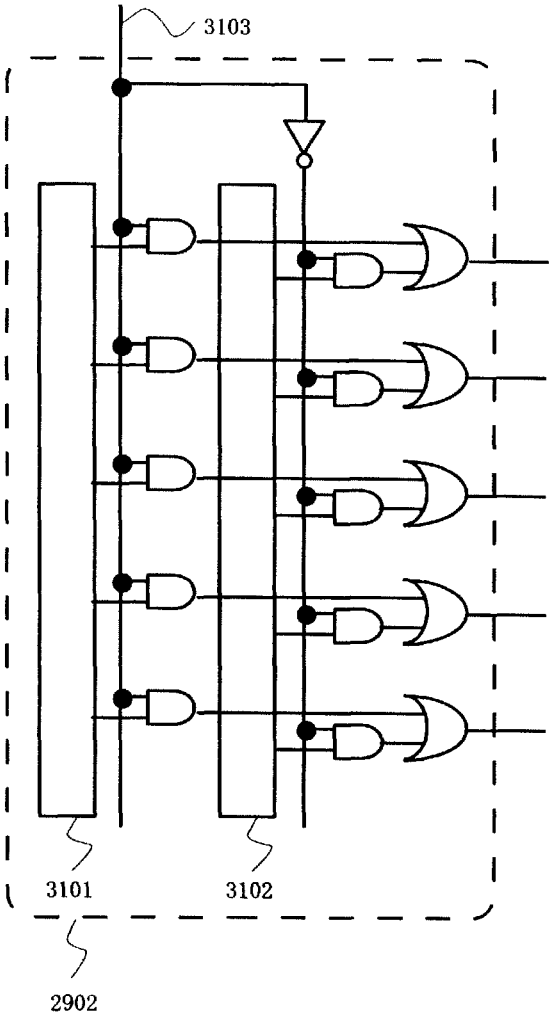
FIG. 31 is a diagram showing a configuration of a gate driver circuit of the invention.

FIG. 31 shows an example of the gate driver circuit 2902. A plurality of switch units (the switch units 106*a* to 106*e* in FIG. 1) in the unit circuit are turned ON during the pre-charge period. In the setting period, one of the switch units is turned ON. Then, a signal which turns ON a plurality of rows of pixels is input from a shift register 3101 as shown in FIG. 31. On the other hand, a signal which turns ON one row of the pixels is input from a shift register 3102. By controlling a control signal line 3103, the outputs of the shift registers 3101 and 3102 are switched to each gate line.

Note that ON/OFF of other switches in the pixel (unit circuit) can also be controlled by a gate driver circuit using the similar technology.

In the case of applying the invention to the pixel, current is not supplied to a load (such as a light-emitting element) during the pre-charge period depending on the configuration of the pixel (unit circuit). In that case, the light-emitting element does not emit light. Therefore, an impulse light emission in which light is emitted for a certain period within one frame period, but a hold light emission in which light is emitted constantly during one frame period is obtained. In the case of the hold light emission, an afterimage may remain in human eyes due to the afterimage effect when a moving image is displayed, while in the case of the impulse light emission, an afterimage is not likely to remain even when a moving image is displayed. Therefore, when the invention is applied to a pixel, an afterimage during a moving image display can be suppressed.

Note that this embodiment mode utilizes Embodiment Modes 1 to 3, therefore, Embodiment Modes 1 to 3 can be applied to this embodiment mode.

Embodiment Mode 5

Described in embodiment modes heretofore is the case of supplying current through a signal line, however, the invention is not limited to this. Not only current but also voltage may be supplied. For example, the technology disclosed in Japanese Patent Application No. 2003-123000 by the same applicant may be combined with the invention.

Figure 37:
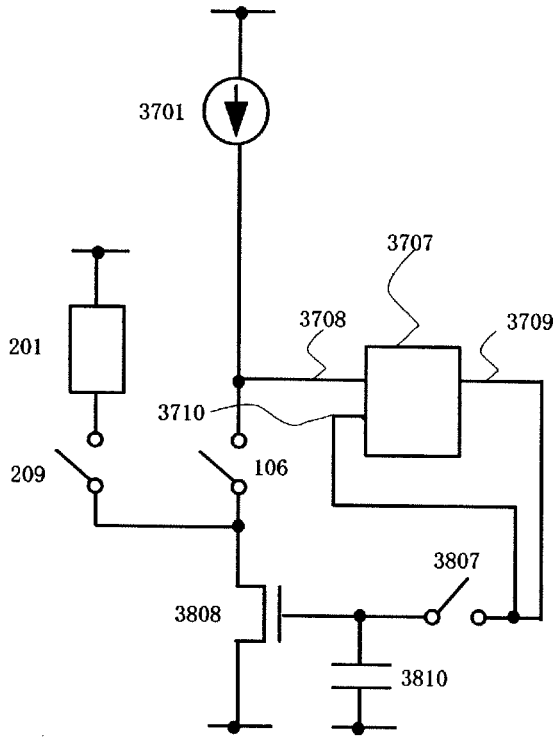
FIG. 37 is a diagram showing a configuration of a semiconductor device of the invention.

As shown in FIG. 37, according to Japanese Patent Application No. 2003-123000, not only current but also voltage is supplied. By composing a feedback circuit using an amplifier circuit 3707, voltage is supplied. The detailed description of its operation is omitted here.

Figure 38:
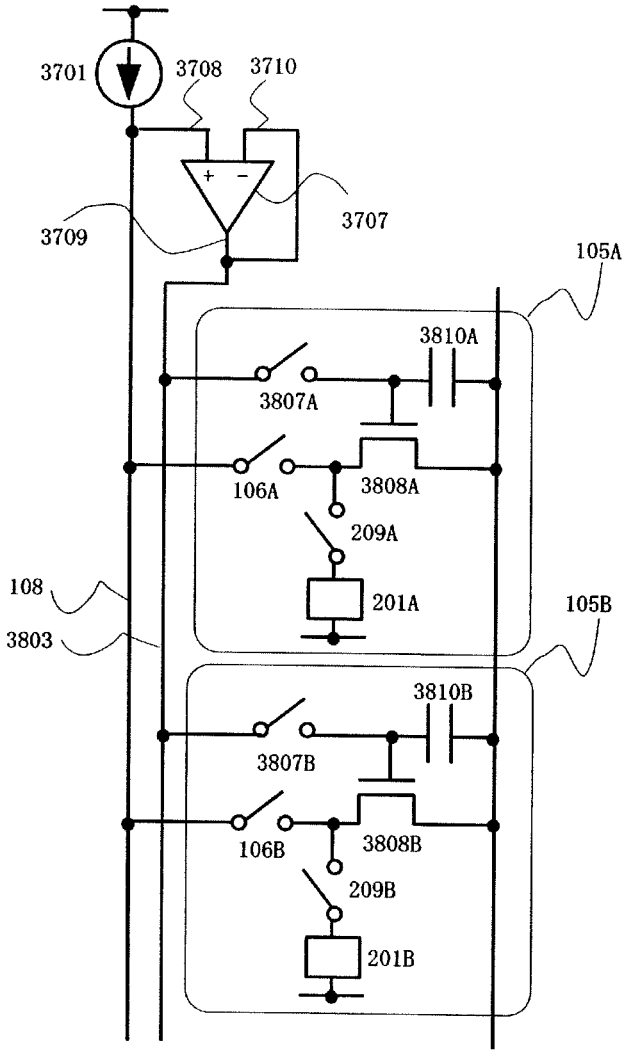
FIG. 38 is a diagram showing a configuration of a semiconductor device of the invention.

FIG. 38 shows the case of disposing a plurality of transistors 3808 in the current source circuit shown in FIG. 37. Here, an operational amplifier 3707 is used as the amplifier circuit. Although two transistors (or pixels) are disposed in a current source circuit for ease of description here, the number is not limited to this.

As shown in FIG. 38, unit circuits 105A and 105B are disposed. Also, the signal line 108 for supplying current and a signal line 3803 for supplying voltage are disposed. These signal lines are connected to a current source circuit in each unit circuit through a switch circuit (switches 106A and 3807A) and the like. By controlling the switch circuits (the switches 106A and 3807A and switches 106B and 3807B) in each unit circuit, the pre-charge operation and the setting operation are performed. Consequently, a signal can be written quickly.

Although only a current source 3701 is shown as a current source in FIG. 38 for ease of description, the magnitude of current may be controlled in the pre-charge operation and the setting operation. The current source 3701 may comprise the switches 102 and 104, the basic current source 101, the additional current source 103 and the like as shown in FIG. 1.

Embodiment Mode 6

In FIGS. 13 to 21, the five unit circuits 105*a* to 105*e* are connected to the signal line 108, and a pre-charge operation is performed by supplying a current to the three unit circuits. In the actual display device, a signal line is connected to more pixels, namely more unit circuits.

For example, in the case of a display device for mobile phone, a vertically long screen with QVGA is adopted, and thus a signal line is connected to 320 pixels (unit circuits). Meanwhile, in the case of a display device for car navigation system, a horizontally long screen with VGA is adopted, and thus a signal line is connected to 480 pixels (unit circuits). Further, in the case of a display device for personal computer, a horizontally long screen with XGA is adopted, and thus a signal line is connected to 768 pixels (unit circuits).

Described hereinafter is the number of pixels (unit circuits) to be supplied a current in the pre-charge operation when a signal line is connected to a number of pixels (unit circuits).

It is desirable to provide as many pixels (unit circuits) as possible to be supplied a current in a pre-charge operation. This is because, since the current flowing in the pre-charge operation becomes larger, the steady state can be obtained quickly. However, when the current value is increased too much, the power consumption is increased as well. Moreover, when the number of pixels (unit circuits) to be supped a current in the pre-charge operation is increased, the number of pixels which can flow a current to a light-emitting element may be reduced. That is, since data stored by a setting operation may be destroyed by the pre-charge operation, a current can not be supplied to a light-emitting element in a certain period in order to prevent the faulty data display. As a result, the duty ratio may be decreased, leading to a short life of the light-emitting element. Therefore, the number of pixels to be supplied a current in the pre-charge operation may be determined depending on these tradeoffs.

For example, when a current is supplied to 50 pixels (unit circuits) in a pre-charge operation, the current value in the pre-charge operation can be made 50 times larger. In the case of a mobile phone with QVGA display, a signal line is connected to 320 pixels (unit circuits), therefore, the proportion of pixels (unit circuits) to be supplied a current in the pre-charge operation is 50/320=16%. The duty ratio at this time is (320−50)/320=84%, which is within an allowance. When the current value in the pre-charge operation can be made 50 times larger, the time to reach the steady state can be shortened. In particular, in the case of a mobile phone which comprises a small display portion (pixel array portion) and a short signal line, the load capacitance of the signal line is small. Therefore, with the current value of 50 times larger or more, the time to reach the steady state can be shortened sufficiently. Thus, it is preferable that the number of pixels (unit circuits) to be supplied a current in the pre-charge operation is 50 or more, the proportion of pixels (unit circuits) to be supplied a current in the pre-charge operation is 16% or more, and the duty ratio is 84% or less.

However, when the duty ratio is 5% or less, life of a light-emitting element may be shortened. Therefore, the number of pixels (unit circuits) to be supplied a current in the pre-charge operation is desirably determined so as to have a duty ratio of 5% or more, and more preferably 10% or more.

For example, when a current is supplied to 100 pixels (unit circuits) in a pre-charge operation, the current value in the pre-charge operation can be made 100 times larger. In the case of a display device for car navigation system with VGA display, a signal line is connected to 480 pixels (unit circuits), therefore, the proportion of pixels (unit circuits) to be supplied a current in the pre-charge operation is 100/480=20%. The duty ratio at this time is (480−100)1480=79%, which is within an allowance. When the current value in the pre-charge operation can be made 100 times larger, the time to reach the steady state can be shortened. In particular, in the case of a display device for car navigation system, a display portion (pixel array portion) is not very large and a signal line is not very long, and thus the load capacitance of the signal line is not very large. Therefore, with the current value 100 times larger or more, the time to reach the steady state can be shortened sufficiently. Thus, it is preferable that the number of pixels (unit circuits) to be supplied a current in the pre-charge operation is 100 or more, the proportion of pixels (unit circuits) to be supplied a current in the pre-charge operation is 20% or more, and the duty ratio is 79% or less.

However, when the duty ratio is 5% or less, life of a light-emitting element may be shortened. Therefore, the number of pixels (unit circuits) to be supplied a current in the pre-charge operation is desirably determined so as to have a duty ratio of 5% or more, and more preferably 10% or more.

For example, when a current is supplied to 200 pixels (unit circuits) in a pre-charge operation, the current value in the pre-charge operation can be made 200 times larger. In the case of a display device for personal computer with XGA display, a signal line is connected to 768 pixels (unit circuits), therefore, the proportion of pixels (unit circuits) to be supplied a current is supplied in the pre-charge operation is 200/768=26%. The duty ratio at this time is (768−200)/768=73%, which is within an allowance. When the current value in the pre-charge operation can be made 200 times larger, the time to reach the steady state can be shortened. Thus, it is preferable that the number of pixels (unit circuits) to be supplied a current in the pre-charge operation is 200 or more, the proportion of pixels (unit circuits) to be supplied a current in the pre-charge operation is 26% or more, and the duty ratio is 73% or less.

However, when the duty ratio is 5% or less, life of a light-emitting element may be shortened. Therefore, the number of pixels (unit circuits) to be supplied a current in the pre-charge operation is desirably determined so as to have a duty ratio of 5% or more, and more preferably 10% or more.

Note that, the number of pixels to be supplied a current is supplied in a pre-charge operation is not limited to the above. For example, the number of pixels to be supplied a current in the pre-charge operation may be increased so as to have a duty ratio of approximately 50%.

Embodiment Mode 7

The invention can be applied to electric devices such as a video camera, a digital camera, a goggle display (head mount display), a navigation system, a sound reproduction device (car audio, audio component and the like), a laptop personal computer, a game device, a portable information terminal (mobile computer, portable phone, portable game device or a digital book and the like), an image reproduction device with a recording medium (specifically a device with a display which plays the recording medium such as Digital Versatile Disc (DVD) and displays the images) and the like. Specific examples of these electric devices are shown in FIGS. 32A to 32H.

Figure 32A:
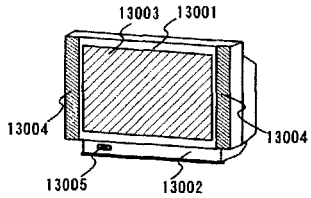
FIGS. 32A to 32H are views showing electronic devices to which the invention can be applied.

FIG. 32A shows a light emitting device which includes a housing 13001, a support stand 13002, a display portion 13003, a speaker portion 13004, a video input terminal 13005, and the like. The invention can be applied to an electric circuit in the display portion 3003. Further, according to the invention, the light emitting device shown in FIG. 32A is completed. Since the light emitting device is of a self-luminous type, no back light is required, and a thinner display portion than a liquid crystal display is achieved. The light emitting device includes all display devices for displaying information such as the one for a personal computer, a TV broadcasting reception, and an advertisement display.

Figure 32B:
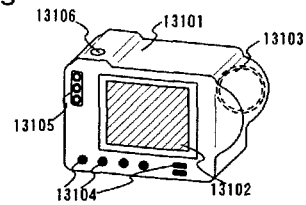

FIG. 32B shows a digital still camera which includes a main body 13101, a display portion 13102, an image receiving portion 13103, operation keys 13104, an external connection port 13105, a shutter 13106, and the like. The invention can be applied to an electric circuit in the display portion 13102. Further, according to the invention, the digital still camera shown in FIG. 32B is completed.

Figure 32C:
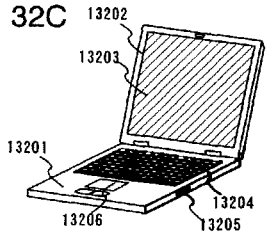

FIG. 32C shows a laptop personal computer which includes a body 13201, a housing 13202, a display portion 13203, a keyboard 13204, an external connection port 13205, a pointing mouse 13206, and the like. The invention can be applied to an electric circuit in the display portion 13203. Further, according to the invention, the laptop personal computer shown in FIG. 32C is completed.

Figure 32D:
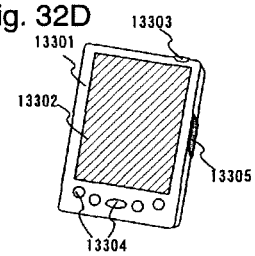

FIG. 32D shows a mobile computer which includes a main body 13301, a display portion 13302, a switch 13303, operation keys 13304, an infrared light port 13305, and the like. The invention can be applied to an electric circuit in the display portion 13302. Further, according to the invention, the mobile computer shown in FIG. 32D is completed.

Figure 32E:
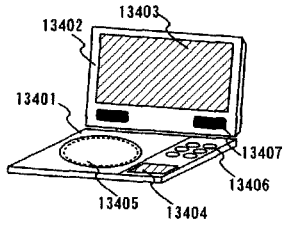

FIG. 32E shows a portable image reproduction device with a recording medium (specifically, a DVD reproduction device) which includes a main body 13401, a housing 13402, a display portion A 13403, a display portion B 13404, a recording medium (DVD and the like) reading portion 13405, an operation key 13406, a speaker portion 13407, and the like. The display portion A 13403 mainly displays image data while the display portion B 13404 mainly displays text data. The invention can be applied to electric circuits in the display portions A 13403 and B 13404. Note that the image reproduction device with a recording medium includes a domestic game device and the like. Further, according to the invention, the DVD reproduction device shown in FIG. 32 E is completed.

Figure 32F:
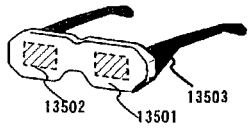

FIG. 32F shows a goggle display (head mounted display) which includes a main body 13501, a display portion 13502, an arm portion 13503, and the like. The invention can be applied to an electrical circuit in the display portion 13502. Further, according to the invention, the goggle display shown in FIG. 32F is completed.

Figure 32G:
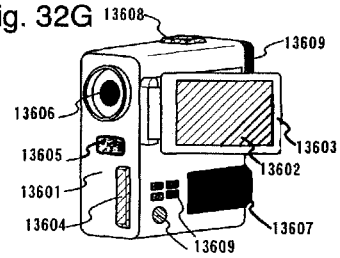

FIG. 32G shows a video camera which includes a main body 13601, a display portion 13602, a housing 13603, an external connection port 13604, a remote control receiving portion 13605, an image receiving portion 13606, a battery 13607, an audio input portion 13608, an operation key 13609, and the like. The invention can be applied to an electrical circuit in the display portion 13602. Further, according to the invention, the video camera shown in FIG. 32G is completed.

Figure 32H:
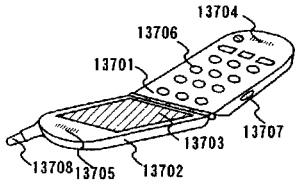
Figure 33:
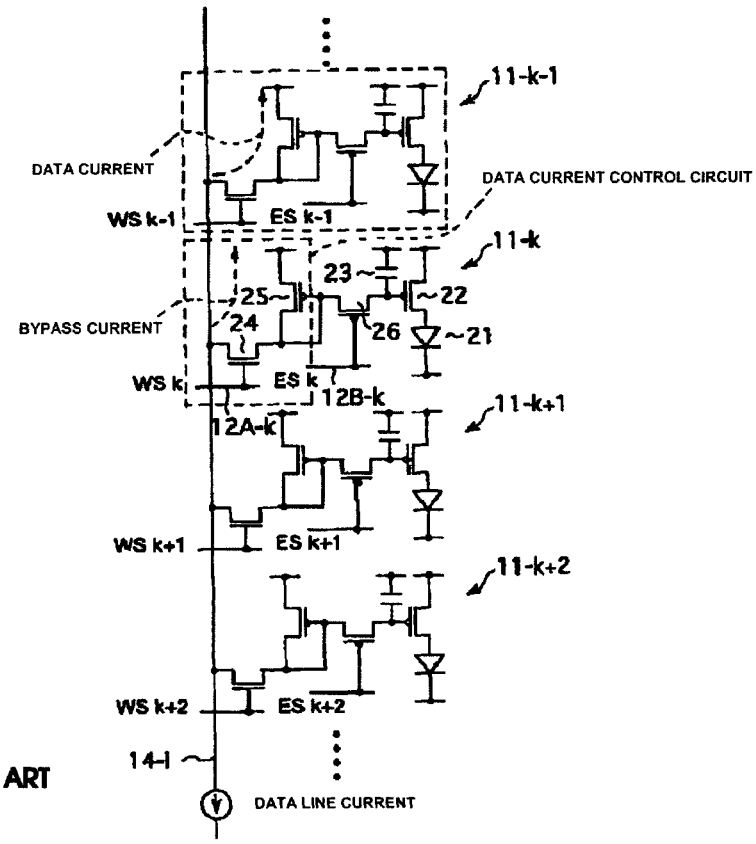
FIG. 33 is a diagram showing a configuration of a conventional pixel.
Figure 34:
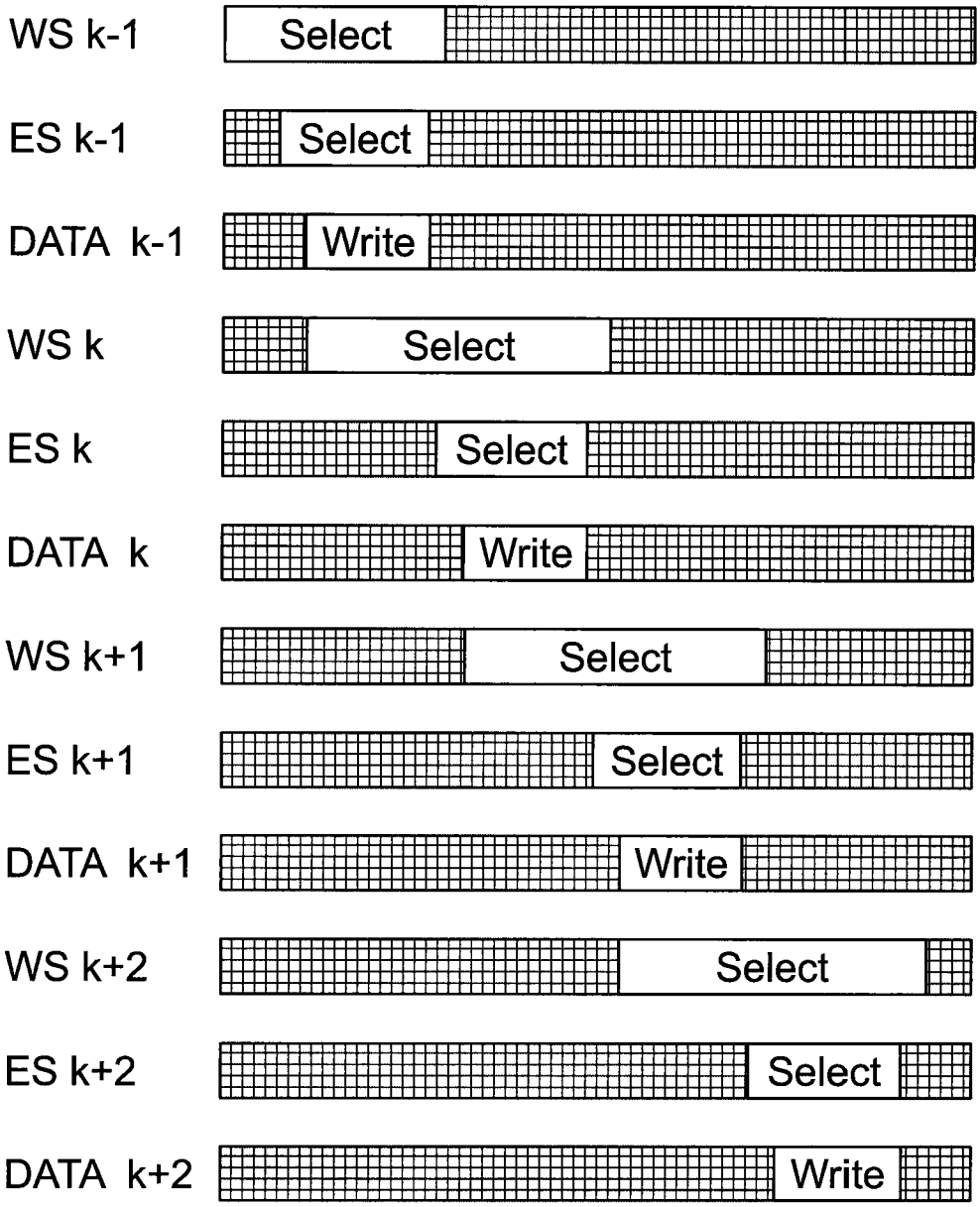
FIG. 34 is a timing chart of a conventional pixel.
Figure 35:
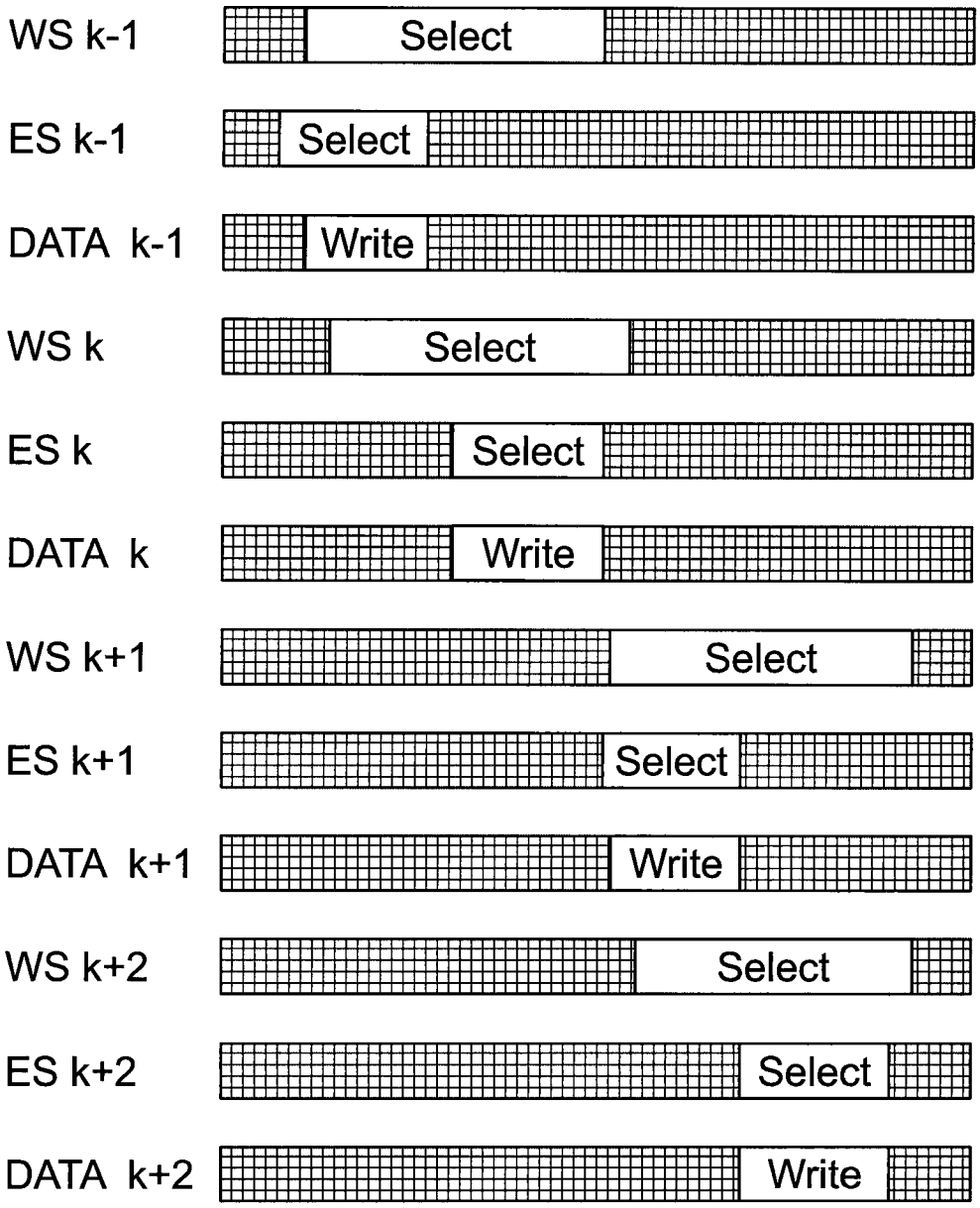
FIG. 35 is a timing chart of a conventional pixel.
Figure 36:
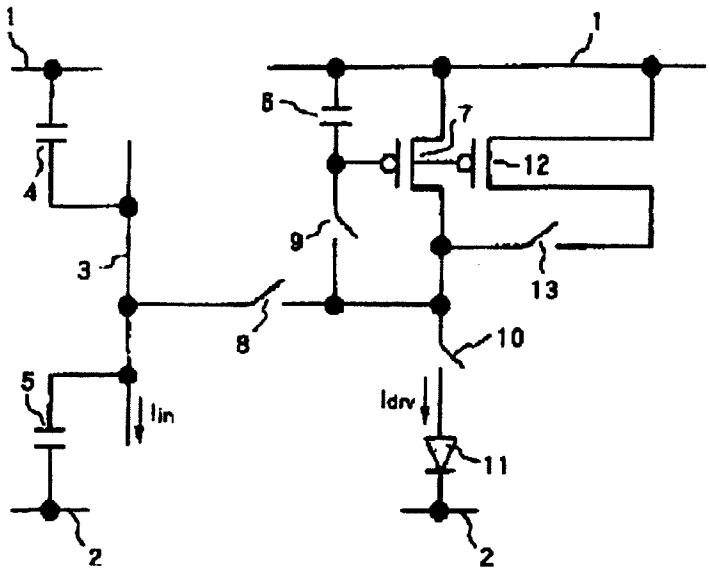
FIG. 36 is a diagram showing a configuration of a conventional pixel.

FIG. 32H shows a mobile phone which includes a main body 13701, a housing 13702, a display portion 13703, an audio input portion 13704, an audio output portion 13705, an operation key 13706, an external connection port 13707, an antenna 13708, and the like. The invention can be applied to an electrical circuit in the display portion 13703. Note that, when the display portion 13703 displays white letters on a black background, the mobile phone consumes less power. Further, according to the invention, the mobile phone shown in FIG. 32H is completed.

If the higher luminance of photons emitted from organic light emitting material becomes available in the future, the semiconductor device of the invention will be applicable to a front or a rear projector in which light including output image data is enlarged by lenses or the like.

The above-described electronic devices are more likely to be used for displaying data transmitted through telecommunication paths such as Internet or a CATV (cable television system), and in particular for displaying moving image data. Since a light emitting material exhibits remarkably high response, a light emitting device is suitably used for a moving image display.

In addition, since a light emitting device consumes power in its light emitting portion, it is desirable that data is displayed so that the light emitting portion occupies as small space as possible. Therefore, in the case of using a light emitting device in a display portion that mainly displays text data such as a mobile phone and a sound reproduction device, it is desirable to drive the device so that text data is displayed by light emitting parts on a non-emitting background.

As described above, an application range of the invention is so wide that the invention can be applied to electronic devices in various fields. The electronic devices in this embodiment can employ a semiconductor device having any configurations shown in the foregoing Embodiment Modes 1 to 6.

This application is based on Japanese Patent Application serial no. 2003-131824 filed in Japan Patent Office on 9, May, 2003, the contents of which are hereby incorporated by reference.

Although the invention has been fully described by way of Embodiment Modes and with reference to the accompanying drawings, it is to be understood that various changes and modifications will be apparent to those skilled in the art. Therefore, unless otherwise such changes and modifications depart from the scope of the invention hereinafter defined, they should be constructed as being included therein.

What is claimed is:

1. A driving method of a semiconductor device comprising a signal line and a plurality of circuits, each comprising a switch and a transistor which is electrically connectable to the signal line through the switch, comprising:

supplying a voltage from the signal line to transistors of M circuits selected from the plurality of the circuits; and supplying a current from the signal line to transistors of N circuits selected from the plurality of circuits, wherein N and M are natural numbers except for zero, and M is greater than N.

2. A driving method of a semiconductor device comprising a signal line and a plurality of circuits, each comprising a switch and a transistor which is electrically connectable to the signal line through the switch, comprising:

supplying a voltage from the signal line to transistors of M circuits selected from the plurality of the circuits; and supplying a current from the signal line to transistors of N circuits selected from the plurality of circuits, wherein N and M are natural numbers except for zero, and M is greater than N, and wherein each of the transistors of the plurality of circuits comprises a thin film transistor.

3. A driving method of a semiconductor device comprising a signal line and a plurality of circuits, each comprising a switch and a transistor which is electrically connectable to the signal line through the switch, comprising:

supplying a voltage from the signal line to transistors of M circuits selected from the plurality of the circuits; and supplying a current from the signal line to transistors of N circuits selected from the plurality of circuits, wherein N and M are natural numbers except for zero, and M is greater than N, and wherein each of the transistors of the plurality of circuits comprises a thin film transistor comprising an amorphous semiconductor.

4. A driving method of a semiconductor device according to claim 1, wherein a current source circuit supplies the current.

5. A driving method of a semiconductor device according to claim 2, wherein a current source circuit supplies the current.

6. A driving method of a semiconductor device according to claim 3, wherein a current source circuit supplies the current.

7. A driving method of a semiconductor device according to claim 1, wherein each of the plurality of circuits further comprises a light emitting element.

8. A driving method of a semiconductor device according to claim 2, wherein each of the plurality of circuits further comprises a light emitting element.

9. A driving method of a semiconductor device according to claim 3, wherein each of the plurality of circuits further comprises a light emitting element.

10. A driving method of a semiconductor device according to claim 1, wherein the semiconductor device is applied to an electric device selected from the group consisting of a video camera, a digital camera, a goggle display, a navigation system, a sound reproduction device, a laptop personal computer, a game device, a portable information terminal, and an image reproduction device with a recording mechanism.

11. A driving method of a semiconductor device according to claim 2, wherein the semiconductor device is applied to an electric device selected from the group consisting of a video camera, a digital camera, a goggle display, a navigation system, a sound reproduction device, a laptop personal computer, a game device, a portable information terminal, and an image reproduction device with a recording mechanism.

12. A driving method of a semiconductor device according to claim 3, wherein the semiconductor device is applied to an electric device selected from the group consisting of a video camera, a digital camera, a goggle display, a navigation system, a sound reproduction device, a laptop personal computer, a game device, a portable information terminal, and an image reproduction device with a recording mechanism.

* * * * *

UNITED STATES PATENT AND TRADEMARK OFFICE

CERTIFICATE OF CORRECTION

PATENT NO. : 8,487,845 B2
APPLICATION NO. : 12/272441
DATED : July 16, 2013
INVENTOR(S) : Hajime Kimura It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1092 days.

Signed and Sealed this
Sixth Day of January, 2015

Michelle K. Lee

Michelle K. Lee
*Deputy Director of the United States Patent and Trademark Office*